US012655494B2

(12) United States Patent
Shuto et al.

(10) Patent No.: US 12,655,494 B2
(45) **Date of Patent: *Jun. 16, 2026**

(54) HOT-ROLLED STEEL SHEET

(71) Applicant: NIPPON STEEL CORPORATION, Tokyo (JP)

(72) Inventors: Hiroshi Shuto, Tokyo (JP); Kazumasa Tsutsui, Tokyo (JP); Koutarou Hayashi, Tokyo (JP); Akifumi Sakakibara, Tokyo (JP); Jun Ando, Tokyo (JP); Mitsuru Yoshida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 517 days.

This patent is subject to a terminal disclaimer.

(21) Appl. No.: 18/016,141

(22) PCT Filed: Jun. 15, 2021

(86) PCT No.: PCT/JP2021/022677
§ 371 (c)(1),
(2) Date: Jan. 13, 2023

(87) PCT Pub. No.: WO2022/044495
PCT Pub. Date: Mar. 3, 2022

(65) Prior Publication Data

US 2023/0257845 A1 Aug. 17, 2023

(30) Foreign Application Priority Data

Aug. 27, 2020 (JP) ..... 2020-143743

(51) Int. Cl.
*C21D 9/46* (2006.01)
*C21D 1/84* (2006.01)
(Continued)

(52) U.S. Cl.
CPC ..... *C21D 9/46* (2013.01); *C21D 1/84* (2013.01); *C21D 8/02* (2013.01); *C21D 8/0226* (2013.01);
(Continued)

(58) Field of Classification Search
CPC ..... C21D 1/84; C21D 2211/001; C21D 2211/005; C21D 2211/009; C21D 8/0205;
(Continued)

(56) References Cited

U.S. PATENT DOCUMENTS 6,544,354 B1 4/2003 Kawano et al.
11,236,412 B2 2/2022 Sano et al.
(Continued)

FOREIGN PATENT DOCUMENTS

CN 103459647 A 12/2013
CN 107250411 A 10/2017
(Continued)

OTHER PUBLICATIONS

NPL: on-line translation of JP-2007070649-A, Mar. 2007 (Year: 2007).*
(Continued)

*Primary Examiner* — Jie Yang
(74) *Attorney, Agent, or Firm* — Birch, Stewart, Kolasch & Birch, LLP

(57) ABSTRACT

This hot-rolled steel sheet has a predetermined chemical composition, in a microstructure, in terms of area %, residual austenite is less than 3.0%, ferrite is 15.0% or more and less than 60.0%, and pearlite is less than 5.0%, an E value that indicates periodicity of the microstructure is 10.7 or more, and an I value that indicates uniformity of the microstructure is less than 1.020, a standard deviation of a Mn concentration is 0.60 mass % or less, and a tensile strength is 980 MPa or more.

4 Claims, 1 Drawing Sheet

(51) Int. Cl.

| | |
|---|---|
| ***C21D 8/02*** | (2006.01) |
| ***C21D 8/0221*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/50*** | (2006.01) |

(52) U.S. Cl.
CPC ..... *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/50* (2013.01); *C21D 2211/001* (2013.01); *C21D 2211/005* (2013.01); *C21D 2211/009* (2013.01)

(58) Field of Classification Search
CPC .... C21D 8/021; C21D 8/0226; C21D 8/0263; C21D 9/46; C22C 38/02; C22C 38/04; C22C 38/06
See application file for complete search history.

(56) References Cited

U.S. PATENT DOCUMENTS

| | | | | |
|---|---|---|---|---|
| 2014/0014236 | A1 | 1/2014 | Nozaki et al. | |
| 2016/0273066 | A1 | 9/2016 | Sakakibara et al. | |
| 2017/0349967 | A1 | 12/2017 | Yokoi et al. | |
| 2018/0044749 | A1 | 2/2018 | Shuto et al. | |
| 2021/0140005 | A1 | 5/2021 | Yoshida et al. | |
| 2023/0295783 | A1* | 9/2023 | Shuto | C22C 38/08 |
| 2023/0323496 | A1* | 10/2023 | Yoshida | C22C 38/58 |
| 2024/0384378 | A1* | 11/2024 | Shuto | C22C 38/34 |
| 2025/0101553 | A1* | 3/2025 | Hiroshima | C22C 38/04 |

FOREIGN PATENT DOCUMENTS

| | | | | |
|---|---|---|---|---|
| EP | 1 028 167 | A2 | | 8/2000 |
| EP | 3 650 569 | A1 | | 5/2020 |
| JP | 59-222528 | A | | 12/1984 |
| JP | 10-168544 | A | | 6/1998 |
| JP | 11-61326 | A | | 3/1999 |
| JP | 3355970 | B2 | | 12/2002 |
| JP | 2005-179703 | A | | 7/2005 |
| JP | 2005-298924 | A | | 10/2005 |
| JP | 2007-70648 | A | | 3/2007 |
| JP | 2007-70661 | A | | 3/2007 |
| JP | 2007070649 | A | * | 3/2007 |
| JP | 4109619 | B2 | | 7/2008 |
| JP | 2009-263685 | A | | 11/2009 |
| JP | 4460343 | B2 | | 5/2010 |
| JP | 2012-251200 | A | | 12/2012 |
| JP | 2016-124410 | A | | 7/2015 |
| JP | 2015-196891 | A | | 11/2015 |
| JP | 2017-150051 | A | | 8/2017 |
| WO | WO 2014/185405 | A1 | | 11/2014 |
| WO | WO 2018/026014 | A1 | | 2/2018 |
| WO | WO 2019/009410 | A1 | | 1/2019 |
| WO | WO 2020/044445 | A1 | | 3/2020 |

OTHER PUBLICATIONS

Naik et al., "Texture-Based Metallurgical Phase Identification in Structural Steels: A Supervised Machine Learning Approach", Metals, 2019, vol. 9, 546, total 13 pages.

Webel et al., "A new analysis approach based on Haralick texture features for the characterization of microstructure on the example of low-alloy steels", Materials Characterization, 2018, vol. 144, pp. 584-596.

Zuiderveld, "Contrast Limited Adaptive Histogram Equalization, Chapter VIII.5", Graphics Gems IV. P.S. Heckbert (Eds.), Cambridge, MA, Academic Press, 1994, pp. 474-485.

U.S. Office Action for U.S. Appl. No. 18/020,598, dated May 13, 2025.

U.S. Office Action for U.S. Appl. No. 18/021,066, dated May 19, 2025.

* cited by examiner

HOT-ROLLED STEEL SHEET

TECHNICAL FIELD

The present invention relates to a hot-rolled steel sheet. Specifically, the present invention relates to a hot-rolled steel sheet that is formed into various shapes by press working or the like to be used, and particularly relates to a hot-rolled steel sheet that has high strength and has excellent ductility and shearing property.

Priority is claimed on Japanese Patent Application No. 2020-143743, filed on Aug. 27, 2020, the content of which is incorporated herein by reference.

BACKGROUND ART

In recent years, from the viewpoint of protecting the global environment, efforts have been made to reduce the amount of carbon dioxide gas emitted in many fields. Vehicle manufacturers are also actively developing techniques for reducing the weight of vehicle bodies for the purpose of reducing fuel consumption. However, it is not easy to reduce the weight of vehicle bodies since the emphasis is placed on improvement in collision resistance to secure the safety of the occupants.

In order to achieve both vehicle body weight reduction and collision resistance, an investigation has been conducted to make a member thin by using a high-strength steel sheet. Therefore, there is a strong demand for a steel sheet having both high strength and excellent formability, and several techniques have been conventionally proposed to meet this demand. Since there are various working methods for vehicle members, the required formability differs depending on members to which the working methods are applied, but among these, ductility is placed as important indices for formability. In addition, vehicle members are formed by press forming, and the press-formed blank sheet is often manufactured by highly productive shearing working. A blank sheet manufactured by shearing working needs to be excellent in terms of the end surface accuracy after shearing working. For example, when the proportion of a sheared surface in an end surface after shearing working (sheared end surface) (hereinafter, the sheared surface proportion) is not stable (the amount of change in the sheared surface proportion is large), the accuracy of the sheared end surface significantly deteriorates.

Regarding the technique for improving ductility, for example, Patent Document 1 discloses a high-strength steel sheet for a vehicle having excellent collision resistant safety and formability, in which residual austenite having an average crystal grain size of 5 μm or less is dispersed in ferrite having an average crystal grain size of 10 μm or less. In the steel sheet containing residual austenite in the microstructure, while the austenite is transformed into martensite during working and large elongation is exhibited due to transformation-induced plasticity, the formation of full hard martensite impairs hole expansibility. Patent Document 1 discloses that not only ductility but also hole expansibility are improved by refining the ferrite and the residual austenite.

Patent Document 2 discloses a high-strength steel sheet having excellent ductility and stretch flangeability and having a tensile strength of 980 MPa or more, in which a second phase consisting of residual austenite and/or martensite is finely dispersed in crystal grains.

Regarding the technique for improving shearing property, for example, Patent Document 3 discloses a technique for controlling burr height after punching by controlling a ratio $d_s/d_b$ of the ferrite grain size $d_s$ of the surface layer to the ferrite crystal grain $d_b$ of an inside to 0.95 or less.

Patent Document 4 discloses a technique for improving separations or burrs on an end surface of a sheet by reducing a P content.

CITATION LIST

Patent Document

Patent Document 1: Japanese Unexamined Patent Application, First Publication No. H11-61326

Patent Document 2: Japanese Unexamined Patent Application, First Publication No. 2005-179703

Patent Document 3: Japanese Unexamined Patent Application, First Publication No. H10-168544

Patent Document 4: Japanese Unexamined Patent Application, First Publication No. 2005-298924

Non-Patent Document

Non-Patent Document 1: J. Webel, J. Gola, D. Britz, F. Mucklich, Materials Characterization 144 (2018) 584-596

Non-Patent Document 2: D. L. Naik, H. U. Sajid, R. Kiran, Metals 2019, 9, 546

Non-Patent Document 3: K. Zuiderveld, Contrast Limited Adaptive Histogram Equalization, Chapter VIII. 5, Graphics Gems IV. P.S. Heckbert (Eds.), Cambridge, MA, Academic Press, 1994, pp. 474-485

SUMMARY OF INVENTION

Technical Problem

The techniques disclosed in Patent Documents 1 to 4 are all techniques for improving either ductility or an end surface property after shearing working. However, Patent Documents 1 to 3 do not refer to a technique for achieving both of the properties. Patent Document 4 refers to achievement of both shearing property and press formability. However, since the strength of a steel sheet disclosed in Patent Document 4 is less than 850 MPa, it may be difficult to apply the steel sheet to a member having a high strength of 980 MPa or more.

The present invention has been made in view of the above problems of the related art, and an object of the present invention is to provide a hot-rolled steel sheet having high strength and excellent ductility and shearing property.

Solution to Problem

In view of the above problems, the present inventors obtained the following findings (a) to (i) as a result of intensive studies on the chemical composition of the hot-rolled steel sheet and a relationship between a microstructure and mechanical properties, and completed the present invention. Having excellent shearing property indicates that the sheared surface proportion in a sheared end surface is stable, that is, the amount of change in the sheared surface proportion is small. In addition, the expression of having excellent strength or having high strength indicates that the tensile strength is 980 MPa or more.

(a) In order to obtain an excellent tensile (maximum) strength, it is preferable to utilize a full hard structure. That is, it is preferable to contain martensite or bainite in the microstructure.

(b) However, since a full hard structure is a structure with poor ductility, excellent ductility cannot be secured simply by forming a microstructure mainly composed of these.

(c) In order to make a high-strength hot-rolled steel sheet also having excellent ductility, it is effective to add an appropriate amount of highly ductile ferrite.

(d) Since ferrite is generally soft, it is necessary to utilize Ti, Nb, V, or the like as a precipitation hardening element in order to obtain a desired strength. Therefore, it is effective to perform intermediate air cooling in the hot rolling process to obtain an appropriate amount of precipitation-hardened ferrite.

(e) In order to stabilize the sheared surface proportion in a sheared end surface, it is important that Mn segregation does not occur much, the microstructural morphology is not periodic, but random, and the microstructure is made to be non-uniform (poorly uniform).

(f) Specifically, it is effective to control the standard deviation of the Mn concentration to a certain value or less and to control the periodicity of the microstructure and the uniformity of the microstructure for stabilizing the sheared surface proportion in the sheared end surface.

(g) In order to control the standard deviation of the Mn concentration to a certain value or less, a slab heating step and a subsequent hot rolling step are important. For example, it is effective that the steel sheet is held in a temperature range of 700° C. to 850° C. for 900 seconds or longer, further heated, and held in a temperature range of 1100° C. or higher for 6000 seconds or longer and that hot rolling is performed such that a total of 90% or more of the sheet thickness reduces in a temperature range of 850° C. to 1100° C.

(h) In order to reduce the periodicity of the microstructural morphology, it is important to control the recrystallization behavior of austenite during hot rolling. For example, it is effective to control the rolling reduction and rolling temperature of the final stage of hot rolling to within a predetermined range, set stress that is loaded to the steel sheet after rolling one stage before the final stage of hot rolling and before the final stage rolling to 170 kPa or more, and set stress that is loaded to the steel sheet after the final stage of hot rolling and until the steel sheet is cooled to 800° C. to less than 200 kPa. Such hot rolling conditions make it possible to produce fine and equiaxed recrystallized austenite grains and make it possible to reduce the periodicity of the microstructural morphology in combination with conditions for subsequent cooling.

(i) In order to reduce the uniformity of the microstructure, it is effective to suppress the precipitation of an iron carbide by cooling the steel sheet to a temperature range of 400° C. or higher and lower than 650° C. after a desired amount of ferrite is obtained by performing intermediate air cooling.

The gist of the present invention made based on the above findings is as follows.

(1) A hot-rolled steel sheet according to one aspect of the present invention containing, in terms of mass %, as a chemical composition, C: 0.050% to 0.250%,
Si: 0.05% to 3.00%,
Mn: 1.00% to 4.00%,
one or two or more of Ti, Nb, and V: 0.060% to 0.500% in total,
sol. Al: 0.001% to 2.000%,
P: 0.100% or less,
S: 0.0300% or less,
N: 0.1000% or less,
O: 0.0100% or less,
Cu: 0% to 2.00%,
Cr: 0% to 2.00%,
Mo: 0% to 1.00%,
Ni: 0% to 2.00%,
B: 0% to 0.0100%,
Ca: 0% to 0.0200%,
Mg: 0% to 0.0200%,
REM: 0% to 0.1000%,
Bi: 0% to 0.020%,
one or two or more of Zr, Co, Zn, and W: 0% to 1.00% in total,
Sn: 0% to 0.05%, and
a remainder comprising Fe and impurities,
in which, in a microstructure,
in terms of area %, residual austenite is less than 3.0%, ferrite is 15.0% or more and less than 60.0%, and pearlite is less than 5.0%,
an E value that indicates periodicity of the microstructure is 10.7 or more, and an I value that indicates uniformity of the microstructure is less than 1.020,
a standard deviation of a Mn concentration is 0.60 mass % or less, and
a tensile strength is 980 MPa or more.

(2) The hot-rolled steel sheet according to (1), in which an average crystal grain size of a surface layer may be less than 3.0 μm.

(3) The hot-rolled steel sheet according to (1) or (2) may further contain, in terms of mass %, one or two or more selected from the group consisting of, as the chemical composition Cu: 0.01% to 2.00%,
Cr: 0.01% to 2.00%,
Mo: 0.01% to 1.00%,
Ni: 0.02% to 2.00%,
B: 0.0001% to 0.0100%,
Ca: 0.0005% to 0.0200%,
Mg: 0.0005% to 0.0200%,
REM: 0.0005% to 0.1000%, and
Bi: 0.0005% to 0.020%.

Advantageous Effects of Invention

According to the above aspect according to the present invention, it is possible to obtain a hot-rolled steel sheet having excellent strength, ductility, and shearing property. In addition, according to the preferable aspect according to the present invention, it is possible to obtain a hot-rolled steel sheet which has the above various properties and, furthermore, suppresses the occurrence of inside bend cracking, that is, has excellent inside bend cracking resistance.

The hot-rolled steel sheet according to the above aspect of the present invention is suitable as an industrial material used for vehicle members, mechanical structural members, and building members.

EMBODIMENTS OF THE INVENTION

Figure 1A:
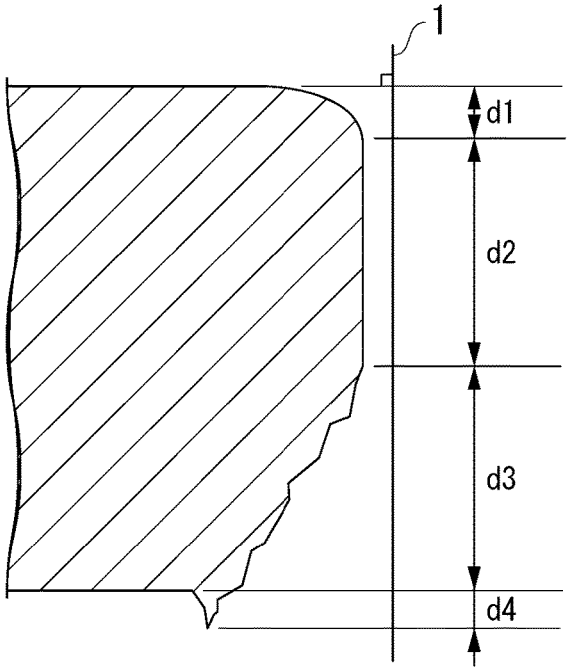
FIG. 1 is a view for describing a method for measuring the proportion of a sheared surface in an end surface after shearing working.

The chemical composition and microstructure of a hot-rolled steel sheet according to the present embodiment (hereinafter, sometimes simply referred to as the steel sheet)

will be more specifically described below. However, the present invention is not limited only to a configuration disclosed in the present embodiment, and various modifications can be made without departing from the scope of the gist of the present invention.

The numerical limit range described below with "to" in between includes the lower limit and the upper limit. Regarding the numerical value indicated by "less than" or "more than", the value does not fall within the numerical range. In the following description, % regarding the chemical composition of the steel sheet is mass % unless particularly otherwise specified.

1. Chemical Composition

The hot-rolled steel sheet according to the present embodiment includes, in terms of mass %, C: 0.050% to 0.250%, Si: 0.05% to 3.00%, Mn: 1.00% to 4.00%, one or two or more of Ti, Nb, and V: 0.060% to 0.500% in total, sol. Al: 0.001% to 2.000%, P: 0.100% or less, S: 0.0300% or less, N: 0.1000% or less, O: 0.0100% or less, and a remainder comprising Fe and impurities. Each element will be described in detail below.

(1-1) C: 0.050% to 0.250%

C increases the fraction of a hard phase and increases the strength of ferrite by bonding to a precipitation hardening element such as Ti, Nb, or V. When the C content is less than 0.050%, it is difficult to obtain a desired strength. Therefore, the C content is set to 0.050% or more. The C content is preferably 0.060% or more, more preferably 0.070% or more, and still more preferably 0.080% or more.

On the other hand, when the C content is more than 0.250%, the ductility of the hot-rolled steel sheet deteriorates due to a decrease in the fraction of ferrite. Therefore, the C content is set to 0.250% or less. The C content is preferably 0.150% or less.

(1-2) Si: 0.05% to 3.00%

Si has an action of improving the ductility of the hot-rolled steel sheet by promoting the formation of ferrite and has an action of increasing the strength of the hot-rolled steel sheet by the solid solution strengthening of ferrite. In addition, Si has an action of making steel sound by deoxidation (suppressing the occurrence of a defect such as a blowhole in steel). When the Si content is less than 0.05%, an effect by the action cannot be obtained. Therefore, the Si content is set to 0.05% or more. The Si content is preferably 0.50% or more and more preferably 0.80% or more.

However, when the Si content is more than 3.00%, the surface properties, chemical convertibility, furthermore, ductility, and weldability of the steel sheet significantly deteriorate, and the $A_3$ transformation point significantly increases. Therefore, it becomes difficult to perform hot rolling in a stable manner. Therefore, the Si content is set to 3.00% or less. The Si content is preferably 2.70% or less and more preferably 2.50% or less.

(1-3) Mn: 1.00% to 4.00%

Mn has an action of suppressing ferritic transformation to achieve the high-strengthening of the hot-rolled steel sheet. When the Mn content is less than 1.00%, a tensile strength of 980 MPa or more cannot be obtained. Therefore, the Mn content is set to 1.00% or more. The Mn content is preferably 1.30% or more and more preferably 1.50% or more.

On the other hand, when the Mn content is more than 4.00%, due to the segregation of Mn, the form of the hard phase becomes a periodic band shape, and it becomes difficult to obtain a desired shearing property. Therefore, the Mn content is set to 4.00% or less. The Mn content is preferably 3.70% or less and more preferably 3.50% or less.

(1-4) One or Two or More of Ti, Nb, and V: 0.060% to 0.500% in Total

Ti, Nb, and V are elements that are finely precipitated in steel as a carbide and a nitride and improve the strength of steel by precipitation hardening. In addition, Ti, Nb, and V are elements that fix C by forming the above carbide and suppress the formation of cementite that is harmful to shearing property. When the total amount of Ti, Nb, and V is less than 0.060%, these effects cannot be obtained. Therefore, the total amount of Ti, Nb, and V is set to 0.060% or more. Not all of Ti, Nb, and V need to be contained, and any one thereof may be contained, and the total amount thereof may be 0.060% or more. The total amount of Ti, Nb, and V is preferably 0.080% or more and more preferably 0.100% or more.

On the other hand, when the total amount of Ti, Nb, and V exceeds 0.500%, the workability deteriorates. Therefore, the total amount of Ti, Nb, and V is set to 0.500% or less. The total amount of Ti, Nb, and V is preferably 0.300% or less, more preferably 0.250% or less, and still more preferably 0.200% or less.

(1-5) Sol. Al: 0.001% to 2.000%

Similar to Si, Al has an action of making steel sound by deoxidizing the steel and has an action of enhancing the ductility of the hot-rolled steel sheet by promoting the formation of ferrite. When the sol. Al content is less than 0.001%, an effect by the action cannot be obtained. Therefore, the sol. Al content is set to 0.001% or more. The sol. Al content is preferably 0.010% or more.

On the other hand, when the sol. Al content is more than 2.000%, the above effects are saturated, which is not economically preferable, and thus the sol. Al content is set to 2.000% or less. The sol. Al content is preferably 1.500% or less, more preferably 1.300% or less, and still more preferably 1.000% or less.

The sol. Al means acid-soluble Al and refers to solid solution Al present in steel in a solid solution state.

(1-6) P: 0.100% or Less

P is an element that is generally contained as an impurity, and has an action of increasing the strength of the hot-rolled steel sheet by solid solution strengthening. Therefore, P may be positively contained, but P is an element that is easily segregated, and, when the P content exceeds 0.100%, the deterioration of ductility attributed to boundary segregation becomes significant. Therefore, the P content is limited to 0.100% or less. The P content is preferably 0.030% or less. The lower limit of the P content does not need to be particularly specified, but is preferably set to 0.001% from the viewpoint of the refining cost.

(1-7) S: 0.0300% or Less

S is an element that is contained as an impurity and forms a sulfide-based inclusion in steel to degrade the ductility of the hot-rolled steel sheet. When the S content is more than 0.0300%, the ductility of the hot-rolled steel sheet significantly deteriorates. Therefore, the S content is limited to 0.0300% or less. The S content is preferably 0.0050% or less. The lower limit of the S content does not need to be particularly specified, but is preferably set to 0.00010% from the viewpoint of the refining cost.

(1-8) N: 0.1000% or Less

N is an element that is contained in steel as an impurity and has an action of degrading the ductility of the hot-rolled steel sheet. When the N content is more than 0.1000%, the ductility of the hot-rolled steel sheet significantly deteriorates. Therefore, the N content is set to 0.1000% or less. The N content is preferably 0.0800% or less, more preferably 0.0700% or less, and still more preferably 0.0100% or less.

Although the lower limit of the N content does not need to be particularly specified, in a case where one or two or more of Ti, Nb, and V are contained to further refine the microstructure, the N content is preferably set to 0.0010% or more and more preferably set to 0.0020% or more to promote the precipitation of a carbonitride.

(1-9) O: 0.0100% or Less

When a large amount of O is contained in steel, O forms a coarse oxide that becomes the starting point of fracture and causes brittle fracture and hydrogen-induced cracks. Therefore, the O content is set to 0.0100% or less. The O content is preferably 0.0080% or less and more preferably 0.0050% or less. The O content may be set to 0.0005% or more or 0.0010% or more to disperse a large number of fine oxides when molten steel is deoxidized.

The remainder of the chemical composition of the hot-rolled steel sheet according to the present embodiment may be Fe and an impurity. In the present embodiment, the impurities mean substances that are incorporated from ore as a raw material, a scrap, manufacturing environment, or the like and/or substances that are permitted to an extent that the hot-rolled steel sheet according to the present embodiment is not adversely affected.

Instead of a part of Fe, the hot-rolled steel sheet according to the present embodiment may contain Cu, Cr, Mo, Ni, B, Ca, Mg, REM, Bi, Zr, Co, Zn, W, and Sn as optional elements. In a case where the above optional elements are not contained, the lower limit of the content thereof is 0%. Hereinafter, the above optional elements will be described in detail.

(1-10) Cu: 0.01% to 2.00%, Cr: 0.01% to 2.00%, Mo: 0.01% to 1.00%, Ni: 0.02% to 2.00%, and B: 0.0001% to 0.0100%

All of Cu, Cr, Mo, Ni, and B have an action of enhancing the hardenability of the hot-rolled steel sheet. In addition, Cu and Mo have an action of being precipitated as a carbide in steel to increase the strength of the hot-rolled steel sheet. Furthermore, in a case where Cu is contained, Ni has an action of effectively suppressing the grain boundary cracking of a slab caused by Cu. Therefore, one or two or more of these elements may be contained.

Cu has an action of enhancing the hardenability of the hot-rolled steel sheet and an action of being precipitated as a carbide in steel at a low temperature to increase the strength of the hot-rolled steel sheet. In order to more reliably obtain the effect by the action, the Cu content is preferably set to 0.010% or more and more preferably set to 0.05% or more. However, when the Cu content is more than 2.00%, grain boundary cracking may occur in the slab in some cases. Therefore, the Cu content is set to 2.00% or less. The Cu content is preferably 1.50% or less and more preferably 1.00% or less.

As described above, Cr has an action of enhancing the hardenability of the hot-rolled steel sheet. In order to more reliably obtain the effect by the action, the Cr content is preferably set to 0.01% or more and more preferably set to 0.05% or more. However, when the Cr content is more than 2.00%, the chemical convertibility of the hot-rolled steel sheet significantly deteriorates. Therefore, the Cr content is set to 2.00% or less.

As described above, Mo has an action of enhancing the hardenability of the hot-rolled steel sheet and an action of being precipitated as a carbide in steel to increase the strength of the hot-rolled steel sheet. In order to more reliably obtain the effect by the action, the Mo content is preferably set to 0.01% or more and more preferably set to 0.02% or more. However, even when the Mo content is set to more than 1.00%, the effect by the action is saturated, which is not economically preferable. Therefore, the Mo content is set to 1.00% or less. The Mo content is preferably 0.50% or less and more preferably 0.20% or less.

As described above, Ni has an action of enhancing the hardenability of the hot-rolled steel sheet. In addition, in a case where Cu is contained, Ni has an action of effectively suppressing the grain boundary cracking of the slab caused by Cu. In order to more reliably obtain the effect by the action, the Ni content is preferably set to 0.02% or more. Since Ni is an expensive element, it is not economically preferable to contain a large amount of Ni. Therefore, the Ni content is set to 2.00% or less.

As described above, B has an action of enhancing the hardenability of the hot-rolled steel sheet. In order to more reliably obtain the effect by this action, the B content is preferably set to 0.0001% or more and more preferably set to 0.0002% or more. However, when the B content is more than 0.0100%, the formability of the hot-rolled steel sheet significantly deteriorates, and thus the B content is set to 0.0100% or less. The B content is preferably 0.0050% or less.

(1-11) Ca: 0.0005% to 0.0200%, Mg: 0.0005% to 0.0200%, REM: 0.0005% to 0.1000%, and Bi: 0.0005% to 0.020%

All of Ca, Mg, and REM have an action of enhancing the ductility of the hot-rolled steel sheet by adjusting the shape of inclusions in steel to a preferable shape. In addition, Bi has an action of enhancing the ductility of the hot-rolled steel sheet by refining the solidification structure. Therefore, one or two or more of these elements may be contained. In order to more reliably obtain the effect by the action, it is preferable that any one or more of Ca, Mg, REM, and Bi are set to 0.0005% or more. However, when the Ca content or Mg content is more than 0.0200% or when the REM content is more than 0.1000%, an inclusion is excessively formed in steel, and thus the ductility of the hot-rolled steel sheet may be conversely degraded in some cases. In addition, even when the Bi content is set to more than 0.020%, the above effect by the action is saturated, which is not economically preferable. Therefore, the Ca content and the Mg content are set to 0.0200% or less, the REM content is set to 0.1000% or less, and the Bi content is set to 0.020% or less. The Bi content is preferably 0.010% or less.

Here, REM refers to a total of 17 elements consisting of Sc, Y, and lanthanoids, and the REM content refers to the total amount of these elements. In the case of the lanthanoids, the lanthanoids are industrially added in the form of misch metal.

(1-12) One or Two or More of Zr, Co, Zn, or W: 0% to 1.00% in Total and Sn: 0% to 0.05%

Regarding Zr, Co, Zn, and W, the present inventors have confirmed that, even when a total of 1.00% or less of these elements are contained, the effect of the hot-rolled steel sheet according to the present embodiment is not impaired. Therefore, one or two or more of Zr, Co, Zn, or W may be contained in a total of 1.00% or less.

In addition, the present inventors have confirmed that, even when a small amount of Sn is contained, the effect of the hot-rolled steel sheet according to the present embodiment is not impaired. However, when a large amount of Sn is contained, a defect may be generated during hot rolling, and thus the Sn content is set to 0.05% or less.

The chemical composition of the above hot-rolled steel sheet may be measured by a general analytical method. For example, inductively coupled plasma-atomic emission spectrometry (ICP-AES) may be used for measurement. sol. Al may be measured by the ICP-AES using a filtrate after a sample is decomposed with an acid by heating. C and S may be measured by using a combustion-infrared absorption method, N may be measured by using the inert gas melting-thermal conductivity method, and O may be measured using an inert gas melting-non-dispersive infrared absorption method.

2. Microstructure of Hot-Rolled Steel Sheet

Next, the microstructure of the hot-rolled steel sheet according to the present embodiment will be described.

In the microstructure of the hot-rolled steel sheet according to the present embodiment, in terms of area %, residual austenite is less than 3.0%, ferrite is 15.0% or more and less than 60.0%, and pearlite is less than 5.0%, the E value that indicates the periodicity of the microstructure is 10.7 or more, the I value that indicates the uniformity of the microstructure is less than 1.020, and the standard deviation of the Mn concentration is 0.60 mass % or less. Therefore, the hot-rolled steel sheet according to the present embodiment can obtain a high strength and excellent ductility and shearing property. In the present embodiment, the microstructural fractions, the E value, the I value, and the standard deviation of the Mn concentration in the microstructure at a depth of ¼ of the sheet thickness from the surface and the center position in the sheet width direction in a cross section parallel to the rolling direction are specified. The reason therefor is that the microstructure at this position indicates a typical microstructure of the steel sheet.

(2-1) Area Fraction of Residual Austenite: Less than 3.0%

Residual austenite is a microstructure that is present as a face-centered cubic lattice even at room temperature. Residual austenite has an action of enhancing the ductility of the hot-rolled steel sheet by transformation-induced plasticity (TRIP). On the other hand, residual austenite transforms into high-carbon martensite during shearing working, which inhibits the stable occurrence of cracking and causes the sheared surface proportion in a sheared end surface unstable. When the area fraction of the residual austenite is 3.0% or more, the action is actualized, and the shearing property of the hot-rolled steel sheet deteriorates. Therefore, the area fraction of the residual austenite is set to less than 3.0%. The area fraction of the residual austenite is preferably less than 1.5% and more preferably less than 1.0%. Since residual austenite is preferably as little as possible, the area fraction of the residual austenite may be 0%.

As the measurement method of the area fraction of the residual austenite, methods by X-ray diffraction, electron back scatter diffraction image (EBSP, electron back scattering diffraction pattern) analysis, and magnetic measurement and the like may be used and the measured values may differ depending on the measurement method. In the present embodiment, the area fraction of the residual austenite is measured by X-ray diffraction.

In the measurement of the area fraction of the residual austenite by X-ray diffraction in the present embodiment, first, the integrated intensities of a total of 6 peaks of $\alpha(110)$, $\alpha(200)$, $\alpha(211)$, $\gamma(111)$, $\gamma(200)$, and $\gamma(220)$ are obtained in the cross section parallel to the rolling direction at a depth of ¼ of the sheet thickness (a region between a depth of ⅛ of the sheet thickness from the surface and a depth of ⅜ of the sheet thickness from the surface) and the center position in the sheet width direction of the hot-rolled steel sheet using Co-Ku rays, and the area fraction of the residual austenite is obtained by calculation using the strength averaging method.

(2-2) Area Fraction of Ferrite: 15.0% or More and Less than 60.0%

Ferrite is a structure formed when fcc transforms into bcc at a relatively high temperature. Ferrite has a high work hardening rate and thus has an action of enhancing the strength-ductility balance of the hot-rolled steel sheet. In order to obtain the above action, the area fraction of the ferrite is set to 15.0% or more. The area fraction of the ferrite is preferably 20.0% or more, more preferably 25.0% or more, and still more preferably 30.0% or more.

Since ferrite has a low strength, when the area fraction is excessive, a desired tensile strength cannot be obtained. Therefore, the area fraction of the ferrite is set to less than 60.0%. The area fraction of the ferrite is preferably 50.0% or less and more preferably 45.0% or less.

(2-3) Area Fraction of Pearlite: Less than 5.0%

Pearlite is a lamellar microstructure in which cementite is precipitated in layers between ferrite and is a soft microstructure as compared with bainite and martensite. When the area fraction of the pearlite is 5.0% or more, carbon is consumed by cementite that is contained in pearlite, and the strengths of martensite and bainite, which are the remainder in microstructure, decrease, and a tensile strength of 980 MPa or more cannot be obtained. Therefore, the area fraction of the pearlite is set to less than 5.0%. The area fraction of the pearlite is preferably 3.0% or less. In order to improve the stretch flangeability of the steel sheet, the area fraction of the pearlite is preferably reduced as much as possible, and the area fraction of the pearlite is more preferably 0%.

The steel sheet according to the present embodiment contains a full hard structure consisting of one or two or more of bainite, martensite, and tempered martensite in a total area fraction of more than 32.0% and 85.0% or less as the remainder in microstructure other than residual austenite, ferrite, and pearlite.

Measurement of the area fractions of the microstructure is conducted by the following method. A cross section parallel to the rolling direction is mirror-finished and, furthermore, polished at room temperature with colloidal silica not containing an alkaline solution for 8 minutes, thereby removing strain introduced into the surface layer of a sample. In a random position of the sample cross section in a longitudinal direction, a region with a length of 50 μm and at a ¼ depth position of the sheet thickness from the surface (a region between a depth of ⅛ of the sheet thickness from the surface and a depth of ⅜ of the sheet thickness from the surface) and the center position in the sheet width direction is measured by electron backscatter diffraction at a measurement interval of 0.1 μm to obtain crystal orientation information. For the measurement, an EBSD analyzer configured of a thermal field emission scanning electron microscope (JSM-7001F manufactured by JEOL) and an EBSD detector (DVC5 type detector manufactured by TSL) is used. At this time, the degree of vacuum inside the EBSD analyzer is set to $9.6\times10^{-5}$ Pa or less, the acceleration voltage is set to 15 kV, the irradiation current level is set to 13, and the electron beam irradiation level is set to 62.

Furthermore, a reflected electron image is photographed at the same visual field. First, crystal grains where ferrite and cementite are precipitated in layers are specified from the reflected electron image, and the area fraction of the crystal grains is calculated, thereby obtaining the area fraction of pearlite. After that, for crystal grains except the crystal grains determined as pearlite, from the obtained crystal orientation information, regions where the grain average misorientation value is 1.0° or less are determined as ferrite using a "Grain Average Misorientation" function installed in software "OIM Analysis (registered trademark)" included in the EBSD analyzer. The area fraction of the region determined as the ferrite is obtained, thereby obtaining the area fraction of the ferrite.

Subsequently, under a condition of defining a 5° grain boundary in the residual region (a region where the grain average misorientation value is more than 1.0°) as a crystal grain boundary, when the maximum value of "Grain Average IQ" of a ferrite region is indicated by Iα, a region with more than Iα/2 is extracted as bainite, and a region with Iα/2 or less is extracted as "pearlite, martensite, and tempered martensite". The area fraction of the bainite is obtained by calculating the area ratio of the extracted bainite. In addition, the total of the area ratios of the martensite and the tempered martensite is obtained by calculating the area fractions of the extracted "pearlite, martensite, and tempered martensite" and subtracting the area fraction of the pearlite obtained by the above EBSD analysis.

(2-4) E Value: 10.7 or More, I Value: Less than 1.020

In order to stabilize the sheared surface proportion in a sheared end surface, it is important that the periodicity of the microstructure is low and the uniformity of the microstructure is reduced. In the present embodiment, the sheared surface proportion in the sheared end surface is stabilized by controlling the E (Entropy) value that indicates the periodicity of the microstructure and the I (inverse differenced moment norm) value that indicates the uniformity of the microstructure.

The E value represents the periodicity of the microstructure. In a case where the brightness is periodically arranged due to an influence of the formation of a band-like structure or the like, that is, the periodicity of the microstructure is high, the E value decreases. In the present embodiment, since there is a need to make the microstructure poorly periodic, it is necessary to increase the E value. When the E value is less than 10.7, the sheared surface proportion in the sheared end surface is likely to become unstable. From periodically arranged structures as starting points, cracking occurs from the cutting edge of a shearing tool in an extremely early stage of shearing working to form a fractured surface, and then a sheared surface is formed again. This is presumed to make the sheared surface proportion in the sheared end surface to become unstable. Therefore, the E value is set to 10.7 or more. The E value is preferably 10.8 or more and more preferably 11.0 or more. The E value is preferably as high as possible, and the upper limit is not particularly specified and may be set to 13.0 or less, 12.5 or less, or 12.0 or less.

The I value represents the uniformity of the microstructure and increases as the area of a region having certain brightness increases. A high I value means that the uniformity of the microstructure is high. In the present embodiment, since there is a need to make the microstructure poorly uniform, it is necessary to reduce the I value. When the I value is low and the uniformity of the microstructure is low, cracking is likely to occur from the tip of a shearing tool due to an influence of hardness difference attributed to precipitates in crystal grains or an element concentration difference, and the sheared surface proportion can be stabilized. When the I value is 1.020 or more, it is presumed that the sheared surface proportion in the sheared end surface cannot be stabilized. Therefore, the I value is set to less than 1.020. The I value is preferably 1.015 or less and more preferably 1.010 or less. The lower limit of the I value is not particularly specified and may be 0.900 or more, 0.950 or more, or 1.000 or more.

The E value and the I value can be obtained by the following method.

In the present embodiment, the photographing region of a SEM image photographed for calculating the E value and the I value is a ¼ depth position of the sheet thickness from the surface of the steel sheet (a region between a depth of ⅛ of the sheet thickness from the surface and a depth of ⅜ of the sheet thickness from the surface) and the center position in the sheet width direction in a cross section parallel to the rolling direction. The SEM image is photographed using an SU-6600 Schottky electron gun manufactured by Hitachi High-Technologies Corporation with a tungsten emitter and an acceleration voltage of 1.5 kV. Based on the above settings, the SEM image is output at a magnification of 1000 times and a gray scale of 256 gradations.

Next, on an image obtained by cutting out the obtained SEM image into a 880×880-pixel region, a smoothing treatment described in Non-Patent Document 3, in which the contrast-enhanced limit magnification is set to 2.0 and the tile grid size is 8×8 is performed. The smoothed SEM image is rotated counterclockwise from 0 degrees to 179 degrees in increments of 1 degree, excluding 90 degrees, and an image is created at each angle, thereby obtaining a total of 179 images. Next, from each of these 179 images, the frequency values of brightness between adjacent pixels are sampled in a matrix form using the GLCM method described in Non-Patent Document 1.

179 matrixes of the frequency values sampled by the above method are expressed as pk (k=0 . . . 89, 91, . . . 179) where k is a rotation angle from the original image. pk's generated for individual images are summed for all k's (k=0 . . . 89, 91, . . . 179), and then 256×256 matrixes P standardized such that the total of individual components becomes 1 are calculated. Furthermore, the E value and the I value are each calculated using the following formula (1) and formula (2) described in Non-Patent Document 2. In the following formula (1) and formula (2), the value at the $i^{th}$ row in the $j^{th}$ column of the matrix P is expressed as $P_{ij}$.

$$E = -\sum_{i=1,j=1}^{i=256,j=256} P_{ij} \log P_{ij} \tag{1}$$

$$I = -\sum_{i=1,j=1}^{i=256,j=256} P_{ij} / (1 + |i - j| / 256) \tag{2}$$

(2-5) Standard Deviation of Mn Concentration: 0.60 Mass % or Less

The standard deviation of the Mn concentration at the depth of ¼ of the sheet thickness from the surface of the hot-rolled steel sheet according to the present embodiment and the center position in the sheet width direction is 0.60 mass % or less. This makes it possible to uniformly disperse the hard phase and makes it possible to prevent the occurrence of cracking from the cutting edge of the shearing tool in an extremely early stage of shearing working. As a result, it is possible to stabilize the sheared surface proportion in the sheared end surface. The standard deviation of the Mn concentration is preferably 0.50 mass % or less and more preferably 0.47 mass % or less. The value of the lower limit of the standard deviation of the Mn concentration is desirably as small as possible from the viewpoint of suppressing excessively large burrs, but the substantial lower limit is 0.10 mass % due to restrictions in the manufacturing process.

After a cross section parallel to the rolling direction of the hot-rolled steel sheet (L cross section) is mirror polished, and then a depth of ¼ of the sheet thickness from the surface of the steel sheet (a region between a depth of ⅛ of the sheet thickness from the surface and a depth of ⅜ of the sheet thickness from the surface) and the center position in the sheet width direction is measured with an electron probe microanalyzer (EPMA) to measure the standard deviation of the Mn concentration. As the measurement conditions, the acceleration voltage is set to 15 kV, the magnification is set to 5000 times, and the distribution image of a range that is 20 μm long in the sample rolling direction and 20 μm long in the sample sheet thickness direction is measured. More specifically, the measurement interval is set to 0.1 μm, and the Mn concentrations at 40000 or more points are measured. Next, the standard deviation is calculated based on the Mn concentrations obtained from all of the measurement points, thereby obtaining the standard deviation of the Mn concentration.

(2-6) Average Crystal Grain Size of Surface Layer: Less than 3.0 μm

Inside bend cracking in the hot-rolled steel sheet can be suppressed by making the crystal grain size of the surface layer fine. As the strength of the steel sheet increases, it is more likely that cracking occurs from the inside bend during bending (hereinafter, referred to as inside bend cracking). The mechanism of inside bend cracking is presumed as follows. At the time of bending, compressive stress is generated in the inside bend. In the beginning, the working proceeds while the entire inside bend is uniformly distorted; however, as the amount of the working increases, distortion cannot proceed only with uniform distortion, and distortion proceeds with strain locally concentrating (generation of a shear deformation band). As this shear deformation band further grows, cracks are initiated along the shear band from the surface of the inside bend and propagate. It is presumed that the reason for the inside bend cracking to be more likely to occur in association with high-strengthening is that deterioration of work hardening capability in association with high-strengthening makes it difficult for uniform distortion to proceed and makes it easy for bias of distortion to be caused, which generates a shear deformation band at an early stage of the working (or under loose working conditions).

The present inventors found from studies that inside bend cracking becomes significant in steel sheets having a tensile strength of 980 MPa or more. In addition, the present inventors found that, as the crystal grain size of the surface layer of the hot-rolled steel sheet becomes finer, local strain concentration is further suppressed, and it becomes more unlikely that inside bend cracking occurs. In order to obtain the above action, the average crystal grain size of the surface layer of the hot-rolled steel sheet is preferably set to less than 3.0 μm. Therefore, in the present embodiment, the average crystal grain size of the surface layer may be set to less than 3.0 μm. The average crystal grain size of the surface layer is more preferably 2.5 μm or less. The lower limit of the average crystal grain size of the surface layer region is not particularly specified and may be set to 0.5 μm.

In the present embodiment, the surface layer is a region from the surface of the hot-rolled steel sheet to a depth position of 50 μm from the surface.

The crystal grain size of the surface layer is measured using the EBSP-OIM (electron back scatter diffraction pattern-orientation image microscopy) method. The EBSP-OIM method is performed using a device obtained by combining a scanning electron microscope and an EBSP analyzer and OIM Analysis (registered trademark) manufactured by AMETEK, Inc. The analyzable area of the EBSP-OIM method is a region that can be observed with the SEM. The EBSP-OIM method makes it possible to analyze a region with a minimum resolution of 20 nm, which varies depending on the resolution of the SEM.

In a region from the surface of the hot-rolled steel sheet to a depth position of 50 μm from the surface and at the center position in the sheet width direction in a cross section parallel to the rolling direction of the hot-rolled steel sheet, at least 5 visual fields are analyzed at a magnification of 1200 times in a 40 μm×30 μm region, and a place where the angle difference between adjacent measurement points is 5° or more is defined as a crystal grain boundary, and an area-averaged crystal grain size is calculated. The obtained area-averaged crystal grain size is regarded as the average crystal grain size of the surface layer.

3. Tensile Strength Properties

Among the mechanical properties of the hot-rolled steel sheets, the tensile strength properties (tensile strength and total elongation) were evaluated according to JIS Z 2241: 2011. A test piece is a No. 5 test piece of JIS Z 2241: 2011. The sampling position of the tensile test piece may be a ¼ portion from the end portion in the sheet width direction, and a direction perpendicular to the rolling direction may be the longitudinal direction.

In the hot-rolled steel sheet according to the present embodiment, the tensile (maximum) strength is 980 MPa or more. The tensile strength is preferably 1000 MPa or more. When the tensile strength is less than 980 MPa, an applicable component is limited, and the contribution to vehicle body weight reduction is small. The upper limit does not need to be particularly limited and may be set to 1780 MPa from the viewpoint of suppressing the wearing of a die.

In addition, the total elongation is preferably set to 12.0% or more, and the product of the tensile strength and the total elongation (TS×El) is preferably set to 15000 MPa·% or more. The total elongation is more preferably set to 13.0% or more and still more preferably set to 14.0% or more. In addition, the product of the tensile strength and the total elongation is more preferably set to 15500 MPa·% or more and still more preferably 16000 MPa·% MPa or more. The total elongation set to 12.0% or more and the product of the tensile strength and the total elongation set to 15000 MPa·% or more significantly contribute to vehicle body weight reduction without limiting applicable components.

4. Sheet Thickness

The sheet thickness of the hot-rolled steel sheet according to the present embodiment is not particularly limited and may be set to 1.2 to 8.0 mm. When the sheet thickness of the hot-rolled steel sheet is less than 1.2 mm, it may become difficult to secure the rolling finishing temperature and the rolling force may become excessive, which makes hot rolling difficult. Therefore, the sheet thickness of the hot-rolled steel sheet according to the present embodiment may be set to 1.2 mm or more. The sheet thickness is preferably 1.4 mm or more. On the other hand, when the sheet thickness is more than 8.0 mm, it becomes difficult to refine the microstructure, and it may be difficult to obtain the above microstructure. Therefore, the sheet thickness may be set to 8.0 mm or less. The sheet thickness is preferably 6.0 mm or less.

5. Others (5-1) Plating Layer

The hot-rolled steel sheet according to the present embodiment having the above-described chemical composition and microstructure may be provided with a plating layer on the surface for the purpose of improving corrosion resistance and the like and thereby made into a surface-treated steel sheet. The plating layer may be an electro plating layer or a hot-dip plating layer. Examples of the electro plating layer include electrogalvanizing, electro Zn—Ni alloy plating, and the like. Examples of the hot-dip plating layer include hot-dip galvanizing, hot-dip galvannealing, hot-dip aluminum plating, hot-dip Zn—Al alloy plating, hot-dip Zn—Al—Mg alloy plating, hot-dip Zn—Al—Mg—Si alloy plating, and the like. The plating adhesion amount is not particularly limited and may be the same as before. In addition, it is also possible to further enhance the corrosion resistance by performing an appropriate chemical conversion treatment (for example, the application and drying of a silicate-based chromium-free chemical conversion treatment liquid) after plating.

6. Manufacturing Conditions

A suitable method for manufacturing the hot-rolled steel sheet according to the present embodiment having the above-described chemical composition and microstructure is as follows.

In order to obtain the hot-rolled steel sheet according to the present embodiment, it is effective to perform hot rolling after heating a slab under predetermined conditions, perform accelerated cooling to a predetermined temperature range, then, slowly cool the slab, and control the cooling history until coiling.

In the suitable method for manufacturing the hot-rolled steel sheet according to the present embodiment, the following steps (1) to (9) are sequentially performed. The temperature of the slab and the temperature of the steel sheet in the present embodiment refer to the surface temperature of the slab and the surface temperature of the steel sheet. In addition, stress refers to stress that is loaded in the rolling direction of the steel sheet.

(1) The slab is held in a temperature range of 700° C. to 850° C. for 900 seconds or longer, then, further heated, and held in a temperature range of 1100° C. or higher for 6000 seconds or longer.

(2) Hot rolling is performed in a temperature range of 850° C. to 1100° C. so that the sheet thickness is reduced by a total of 90% or more.

(3) Stress of 170 kPa or more is loaded to the steel sheet after rolling one stage before the final stage of the hot rolling and before the final stage rolling.

(4) The rolling reduction at the final stage of the hot rolling is set to 8% or more, and the hot rolling is finished so that the rolling finishing temperature Tf becomes 900° C. or higher and lower than 1010° C.

(5) Stress that is loaded to the steel sheet after the final stage rolling of the hot rolling and until the steel sheet is cooled to 800° C. is set to less than 200 kPa.

(6) The steel sheet is cooled to a temperature range of the hot rolling finishing temperature Tf—50° C. or lower within 1 second after the finishing of the hot rolling, and then accelerated cooling is performed to a temperature range of 600° C. to 730° C. at an average cooling rate of 50° C./sec or faster. Here, the cooling to the temperature range of the hot rolling finishing temperature Tf—50° C. or lower within 1 second after the finishing of the hot rolling is a more preferable cooling condition.

(7) Slow cooling at an average cooling rate of slower than 5° C./s is performed in a temperature range of 600° C. to 730° C. for 2.0 seconds or longer.

(8) The steel sheet is cooled to a temperature range of lower than 600° C. at an average cooling rate of 50° C./s or faster.

(9) The steel sheet is coiled in a temperature range of 400° C. or higher and lower than 600° C.

A hot-rolled steel sheet having a microstructure with excellent strength, ductility, and shearing property can be stably manufactured by adopting the above manufacturing method. That is, when the slab heating conditions and the hot rolling conditions are appropriately controlled, the reduction of Mn segregation and equiaxed austenite before transformation are achieved, and, in cooperation with the cooling conditions after the hot rolling to be described below, a hot-rolled steel sheet having a desired microstructure can be stably manufactured.

(6-1) Slab, Slab Temperature and Holding Time on Hot Rolling

As the slab that is subjected to hot rolling, a slab obtained by continuous casting, a slab obtained by casting and blooming, or the like can be used, and, if necessary, it is possible to use the above slabs after hot working or cold working. The slab that is subjected to hot rolling is preferably held in a temperature range of 700° C. to 850° C. for 900 seconds or longer during slab heating, then, further heated, and held in a temperature range of 1100° C. or higher for 6000 seconds or longer. During holding in the temperature range of 700° C. to 850° C., the steel sheet temperature may be fluctuated or be maintained constant in this temperature range. In addition, during holding at 1100° C. or higher, the steel sheet temperature may be fluctuated or be maintained constant in the temperature range of 1100° C. or higher. In austenite transformation in the temperature range of 700° C. to 850° C., Mn is distributed between ferrite and austenite, and Mn can be diffused into the ferrite region by extending the transformation time. Accordingly, the Mn microsegregation unevenly distributed in the slab can be eliminated, and the standard deviation of the Mn concentration can be significantly reduced. In addition, the steel sheet is held in the temperature range of 1100° C. or higher for 6000 seconds or longer, which makes it possible to uniform austenite grains during slab heating.

In the hot rolling, it is preferable to use a reverse mill or a tandem mill for multi-pass rolling. Particularly, from the viewpoint of industrial productivity and the viewpoint of stress loading on the steel sheet during the rolling, at least the final two stages are more preferably hot rolling in which a tandem mill is used.

(6-2) Rolling Reduction of Hot Rolling: Total Sheet Thickness Reduction of 90% or More in Temperature Range of 850° C. To 1100° C.

When the hot rolling is performed so that the sheet thickness is reduced by a total of 90% or more in a temperature range of 850° C. to 1100° C., mainly recrystallized austenite grains are refined, and accumulation of strain energy into the unrecrystallized austenite grains is promoted. In addition, the recrystallization of austenite is promoted, and the atomic diffusion of Mn is promoted, which makes it possible to reduce the standard deviation of the Mn concentration. Therefore, it is preferable to perform the hot rolling so that the sheet thickness is reduced by a total of 90% or more in the temperature range of 850° C. to 1100° C.

The sheet thickness reduced in the temperature range of 850° C. to 1100° C. can be expressed as $\{(t_0-t_1)/t_0\}\times100(\%)$ where an inlet sheet thickness before the first rolling in the rolling in this temperature range is $t_0$ and an outlet sheet thickness after the final stage rolling in the rolling in this temperature range is $t_1$.

(6-3) Stress after Rolling One Stage Before Final Stage of Hot Rolling and Before Final Stage Rolling: 170 KPa or More The stress that is loaded to the steel sheet after rolling one stage before the final stage of hot rolling and before the final stage rolling is preferably set to 170 kPa or more. This makes it possible to reduce the number of crystal grains having a {110}<001> crystal orientation in the recrystallized austenite after the rolling one stage before the final stage. Since {110}<001> is a crystal orientation that is difficult to recrystallize, recrystallization by the final stage rolling can be effectively promoted by suppressing the formation of this crystal orientation. As a result, the band-like structure of the hot-rolled steel sheet is improved, the periodicity of the microstructure is reduced, and the E value increases. In a case where the stress that is loaded to the steel sheet is less than 170 kPa, it may be impossible to achieve an E value of 10.7 or more. The stress that is loaded to the steel sheet is more preferably 190 kPa or more. The stress that is loaded to the steel sheet can be controlled by adjusting the roll rotation speed during tandem rolling.

(6-4) Rolling Reduction at Final Stage of Hot Rolling: 8% or More, Hot Rolling Finishing Temperature TfL 900° C. Or Higher and Lower than 1010° C.

It is preferable that the rolling reduction at the final stage of the hot rolling is set to 8% or more and the hot rolling finishing temperature Tf is set to 900° C. or higher. When the rolling reduction at the final stage of the hot rolling is set to 8% or more, it is possible to promote recrystallization caused by the final stage rolling. As a result, the band-like structure of the hot-rolled steel sheet is improved, the periodicity of the microstructure is reduced, and the E value increases. When the hot rolling finishing temperature Tf is set to 900° C. or higher, it is possible to suppress an excessive increase in the number of ferrite nucleation sites in austenite. As a result, the formation of ferrite in the final structure (the microstructure of the hot-rolled steel sheet after manufacturing) is suppressed, and a high-strength hot-rolled steel sheet can be obtained. In addition, when Tf is set to lower than 1010° C., it is possible to suppress the coarsening of the austenite grain sizes and to set the E value to 10.7 or more by reducing the periodicity of the microstructure.

(6-5) Stress after Final Stage Rolling of Hot Rolling and Until Steel Sheet being Cooled to 800° C.: Less than 200 KPa Stress that is loaded to the steel sheet after the final stage rolling of the hot rolling and until the steel sheet is cooled to 800° C. is preferably set to less than 200 kPa. When the stress that is loaded to the steel sheet is set to less than 200 kPa, the recrystallization of austenite preferentially proceeds in the rolling direction, and an increase in the periodicity of the microstructure can be suppressed. As a result, the E value can be set to 10.7 or more. The stress that is loaded to the steel sheet is more preferably 180 MPa or less.

(6-6) Steel Sheet being Cooled to Temperature Range of Hot Rolling Finishing Temperature Tf—50° C. Or Lower within 1 Second after Finishing of Hot Rolling, then, Accelerated Cooling being Performed to Temperature Range of 600° C. To 730° C. At Average Cooling Rate of 50° C./Sec or Faster In order to suppress the growth of austenite crystal grain refined by the hot rolling, the steel sheet is more preferably cooled by 50° C. or more within 1 second after the finishing of the hot rolling. In order to cool the steel sheet to a temperature range of the hot rolling finishing temperature Tf—50° C. or lower within 1 second after the finishing of the hot rolling, it is preferable to perform cooling with a fast average cooling rate, for example, spraying of cooling water to the surface of the steel sheet, immediately after the finishing of the hot rolling. When the steel sheet is cooled to the temperature range of Tf—50° C. or lower within 1 second after the finishing of the hot rolling, it is possible to refine the crystal grain size of the surface layer and to enhance the inside bend cracking resistance.

In addition, when accelerated cooling is performed to a temperature range of 730° C. or lower at an average cooling rate of 50° C./sec or faster after the cooling, it is possible to suppress the formation of ferrite and pearlite with a small amount of precipitation hardening. Accordingly, the strength of the hot-rolled steel sheet improves. The average cooling rate referred to herein is a value obtained by dividing the temperature drop width of the steel sheet from the start of accelerated cooling (when introducing the steel sheet into cooling equipment) to the completion of accelerated cooling (when deriving the steel sheet from the cooling equipment) by the time required from the start of accelerated cooling to the completion of accelerated cooling.

The upper limit of the cooling rate is not particularly specified, but when the cooling rate is increased, the cooling equipment becomes large and the equipment cost increases. Therefore, considering the equipment cost, the average cooling rate is preferably 300° C./sec or slower. In addition, the cooling stop temperature of the accelerated cooling may be set to 600° C. or higher.

(6-7) Slow Cooling at Average Cooling Rate of Slower than 5° C./s being Performed in Temperature Range of 600° C. To 730° C. For 2.0 Seconds or Longer When slow cooling at an average cooling rate of slower than 5° C./s is performed in a temperature range of 600° C. to 730° C. for 2.0 seconds or longer, it is possible to sufficiently precipitate the precipitation-hardened ferrite. This makes it possible to achieve both strength and ductility of the hot-rolled steel sheet. The average cooling rate referred to herein refers to a value obtained by dividing the temperature drop width of the steel sheet from the cooling stop temperature of the accelerated cooling to the stop temperature of the slow cooling by the time required from the stop of the accelerated cooling to the stop of the slow cooling.

The slow cooling time is preferably 3.0 seconds or longer. The upper limit of the slow cooling time is determined by the equipment layout and may be set to approximately shorter than 10.0 seconds. In addition, the lower limit of the average cooling rate of the slow cooling is not particularly provided and may be set to 0° C./s or faster since heating the steel sheet without cooling accompanies a huge equipment investment.

(6-8) Average Cooling Rate to Coiling Temperature: 50° C./Sec or Faster

In order to suppress the area fraction of the pearlite and obtain a tensile strength of 980 MPa or more, the average cooling rate from the cooling stop temperature of the slow cooling to the coiling temperature is preferably set to 50° C./sec or faster. In such a case, the primary phase structure can be made full hard. The average cooling rate referred to herein refers to a value obtained by dividing the temperature drop width of the steel sheet from the cooling stop temperature of the slow cooling where the average cooling rate is slower than 5° C./s to the coiling temperature by the time required from the stop of the slow cooling where the average cooling rate is slower than 5° C./s to coiling.

(6-9) Coiling Temperature: 400° C. Or Higher and Lower than 600° C.

The coiling temperature is set in a temperature range of 400° C. or higher and lower than 600° C. When the coiling temperature is set in this temperature range, the amount of an iron carbide precipitated is reduced, and the variation in the hardness distribution in the hard phase can be improved. As a result, it is possible to reduce the I value and to obtain excellent shearing property.

EXAMPLES

Next, the effects of one aspect of the present invention will be described more specifically by way of examples, but the conditions in the examples are condition examples adopted for confirming the feasibility and effects of the present invention. The present invention is not limited to these condition examples. The present invention can adopt various conditions as long as the object of the present invention is achieved without departing from the gist of the present invention.

Steels having a chemical composition shown in Tables 1 and 2 were melted and continuously cast to manufacture slabs having a thickness of 240 to 300 mm. The obtained slabs were used to obtain hot-rolled steel sheets shown in Table 5A to Table 6B under the manufacturing conditions shown in Table 3A to Table 4B. The average cooling rate of slow cooling was set to slower than 5° C./s.

The area fraction of the microstructure, the E value, the I value, the standard deviation of the Mn concentration, the average crystal grain size of the surface layer, the tensile strength TS, and the total elongation El of each the obtained hot-rolled steel sheets were obtained by the above methods. The obtained measurement results are shown in Table 5A to Table 6B.

The remainder in microstructure was one or two or more of bainite, martensite, and tempered martensite.

Evaluation Method of Properties of Hot-Rolled Steel Sheets (1) Tensile Strength Properties In a case where the tensile strength TS was 980 MPa or more, the total elongation El was 12.0% or more, and the tensile strength TS×total elongation El was 15000 MPa·% or more, the hot-rolled steel sheet was considered to be excellent in terms of strength and ductility, and the tensile strength properties were judged to be acceptable. In a case where any one was not satisfied, the hot-rolled steel sheet was not considered to be excellent in terms of strength and ductility, and the tensile strength properties were judged to be unacceptable.

(2) Shearing Property

Figure 1B:
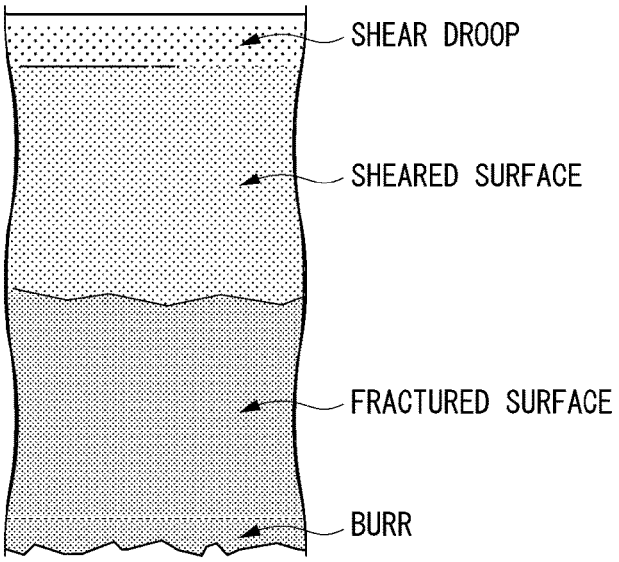

The shearing property of the hot-rolled steel sheet was evaluated by obtaining the sheared surface proportion by a punching test. At the sheet width center position, five punched holes were produced with a hole diameter of 10 mm, a clearance of 15%, and a punching speed of 3 m/s. Next, the appearances of 10 end surfaces parallel to the rolling direction (2 end surfaces per 1 punched hole) were photographed with an optical microscope in the 5 punched holes. In the obtained observation photographs, end surfaces as shown in FIG. 1(*a*) could be observed. As shown in FIGS. 1(*a*) and 1(*b*), a shear droop, a sheared surface, a fractured surface, and a burr are observed on the end surface after punching. FIG. 1(*a*) is a schematic view of the end surface parallel to the rolling direction of the punched hole, and FIG. 1(*b*) is a schematic view of the side surface of the punched hole. The shear droop is an R-like smooth surface, the sheared surface is a punched end surface separated by shear deformation, the fractured surface is a punched end surface separated by a crack initiated from the vicinity of the cutting edge after the end of shear deformation, and a burr is a surface having projections protruding from the lower surface of the hot-rolled steel sheet. In the observation photographs of the 10 end surfaces obtained from the 5 end surfaces, the sheared surface proportions in the end surfaces were measured, and a value obtained by dividing the minimum value of the obtained sheared surface proportions (%) by the maximum value (the minimum value of the sheared surface proportion/the maximum value of the sheared surface proportion) was calculated. In a case where this value was 0.70 or more, the hot-rolled steel sheet was considered to be excellent in terms of shearing property and judged to be acceptable. On the other hand, in a case where this value was less than 0.70, the hot-rolled steel sheet was considered to be poor in shearing property and judged to be unacceptable.

The proportion of the sheared surface in the end surface (sheared surface proportion) can be obtained by drawing a straight line 1 perpendicular to the upper surface and the lower surface of the hot-rolled steel sheet in the observation photograph of the end surface as shown in FIG. 1(*a*) and calculating the proportion of the length d2 of the sheared surface in the total of the length d1 of the shear droop, the length d2 of the sheared surface, the length d3 of the fractured surface, and the length d4 of the burr in the straight line 1 (=d2/(d1+d2+d3+d4)×100).

(3) Inside Bend Cracking Resistance

The inside bend cracking resistance was evaluated by the following bending test.

A 100 mm×30 mm strip-shaped test piece was cut out from a ½ position in the width direction of the hot-rolled steel sheet to obtain a bending test piece. For both a bend where the bending ridge was parallel to the rolling direction (L direction) (L-axis bending) and a bend where the bending ridge was parallel to a direction perpendicular to the rolling direction (C direction) (C-axis bending), inside bend cracking resistance was investigated according to JIS Z 2248: 2014 (V block 90° bending test), and the minimum bend radii at which cracks were not initiated were obtained. A value obtained by dividing the average value of the minimum bend radii in the L axis and in the C axis by the sheet thickness was regarded as the limit bend R/t and used as an index value of inside bend cracking resistance. In a case where R/t was 2.5 or less, the hot-rolled steel sheet was determined to be excellent in terms of inside bend cracking resistance.

Here, regarding the presence or absence of cracks, a cross section obtained by cutting the test piece after the V block 90° bending test on a surface parallel to the bending direction and perpendicular to the sheet surface was mirror polished, then, cracks were observed with an optical microscope, and a case where the lengths of cracks observed in the inside bend of the test piece exceeded 30 μm was determined as cracks being present.

The obtained results are shown in Table 6A and Table 6B.

TABLE 1

| | Mass %, remainder is Fe and impurities | | | | | | | | | | | | |
|---|---|---|---|---|---|---|---|---|---|---|---|---|---|
| Steel No. | C | Si | Mn | Ti | Nb | V | Ti + Nb + V | sol. Al | P | S | N | O | Note |
| A | 0.052 | 1.12 | 1.63 | 0.090 | | | 0.090 | 0.032 | 0.021 | 0.0010 | 0.0036 | 0.0030 | Present Invention Example |
| B | 0.088 | 0.96 | 1.83 | 0.105 | | | 0.105 | 0.029 | 0.012 | 0.0030 | 0.0034 | 0.0034 | Present Invention Example |

TABLE 1-continued

| Steel No. | C | Si | Mn | Ti | Nb | V | Ti + Nb + V | sol. Al | P | S | N | O | Note |
|---|---|---|---|---|---|---|---|---|---|---|---|---|---|
| | Mass %, remainder is Fe and impurities | | | | | | | | | | | | |
| C | 0.151 | 1.27 | 1.87 | 0.126 | | | 0.126 | 0.065 | 0.013 | 0.0040 | 0.0028 | 0.0016 | Present Invention Example |
| D | 0.107 | 0.42 | 1.66 | 0.095 | | | 0.095 | 0.036 | 0.021 | 0.0039 | 0.0040 | 0.0024 | Present Invention Example |
| E | 0.076 | 2.76 | 1.93 | 0.108 | | | 0.108 | 0.038 | 0.029 | 0.0028 | 0.0023 | 0.0025 | Present Invention Example |
| F | 0.097 | 0.94 | 1.28 | 0.105 | | | 0.105 | 0.055 | 0.010 | 0.0041 | 0.0032 | 0.0015 | Present Invention Example |
| G | 0.094 | 1.20 | 3.57 | 0.105 | 0.045 | | 0.150 | 0.032 | 0.029 | 0.0012 | 0.0030 | 0.0046 | Present Invention Example |
| H | 0.097 | 0.80 | 1.78 | 0.065 | | | 0.065 | 0.040 | 0.026 | 0.0035 | 0.0025 | 0.0018 | Present Invention Example |
| I | 0.096 | 1.09 | 1.79 | | | 0.144 | 0.144 | 0.037 | 0.011 | 0.0057 | 0.0032 | 0.0039 | Present Invention Example |
| J | 0.094 | 1.11 | 1.77 | 0.039 | 0.026 | 0.068 | 0.133 | 0.029 | 0.014 | 0.0045 | 0.0032 | 0.0046 | Present Invention Example |
| K | 0.088 | 0.85 | 1.83 | 0.127 | | | 0.127 | 0.044 | 0.016 | 0.0035 | 0.0025 | 0.0042 | Present Invention Example |
| L | 0.073 | 0.84 | 1.73 | 0.115 | | | 0.115 | 0.054 | 0.028 | 0.0028 | 0.0039 | 0.0021 | Present Invention Example |
| M | 0.085 | 1.13 | 1.67 | 0.108 | | 0.055 | 0.163 | 0.045 | 0.025 | 0.0024 | 0.0028 | 0.0037 | Present Invention Example |
| N | 0.079 | 1.07 | 1.58 | 0.099 | | | 0.099 | 0.042 | 0.018 | 0.0044 | 0.0050 | 0.0028 | Present Invention Example |
| O | 0.096 | 1.07 | 1.77 | | 0.199 | | 0.199 | 0.050 | 0.011 | 0.0022 | 0.0034 | 0.0034 | Present Invention Example |
| P | 0.043 | 0.92 | 1.89 | 0.126 | | | 0.126 | 0.029 | 0.008 | 0.0039 | 0.0039 | 0.0019 | Comparative Example |
| Q | 0.260 | 0.91 | 1.78 | 0.113 | | | 0.113 | 0.058 | 0.009 | 0.0035 | 0.0039 | 0.0050 | Comparative Example |
| R | 0.089 | 3.18 | 1.72 | 0.098 | | | 0.098 | 0.029 | 0.022 | 0.0022 | 0.0028 | 0.0032 | Comparative Example |
| S | 0.093 | 0.85 | 0.72 | 0.123 | | | 0.123 | 0.065 | 0.018 | 0.0004 | 0.0068 | 0.0010 | Comparative Example |
| T | 0.107 | 1.09 | 1.84 | 0.042 | 0.011 | | 0.053 | 0.040 | 0.015 | 0.0053 | 0.0019 | 0.0045 | Comparative Example |
| U | 0.071 | 1.43 | 2.07 | 0.111 | | | 0.111 | 0.308 | 0.010 | 0.0025 | 0.0049 | 0.0031 | Present Invention Example |
| V | 0.060 | 1.82 | 2.34 | 0.091 | | | 0.091 | 0.384 | 0.023 | 0.0013 | 0.0021 | 0.0018 | Present Invention Example |

Underlines indicate that corresponding values are outside the range of the present invention.

TABLE 2

| Steel No. | Cu | Cr | Mo | Ni | B | Ca | Mg | REM | Bi | Zr | Co | Zn | W | Sn | Note Present Invention Example |
|---|---|---|---|---|---|---|---|---|---|---|---|---|---|---|---|
| | Mass %, remainder is Fe and impurities | | | | | | | | | | | | | | |
| A | | | | | | 0.0020 | 0.0015 | | | | | | | | Present Invention Example |
| B | | | | | | | | | | | | | | | Present Invention Example |
| C | | | | | | | | 0.0026 | | | | | | | Present Invention Example |
| D | | 0.41 | 0.25 | 0.21 | | | | | | | | | | | Present Invention Example |

TABLE 2-continued

| Steel | Mass %, remainder is Fe and impurities | | | | | | | | | | | | | | Note Present Invention |
|---|---|---|---|---|---|---|---|---|---|---|---|---|---|---|---|
| No. | Cu | Cr | Mo | Ni | B | Ca | Mg | REM | Bi | Zr | Co | Zn | W | Sn | Example |
| E | | | | | | | | | 0.004 | | | | 0.15 | | Present Invention Example |
| F | | | | | | | | | | | | | | | Present Invention Example |
| G | | | | | | | | | | | | | | | Present Invention Example |
| H | | | | | | | | | | 0.02 | | | | | Present Invention Example |
| I | | | | | | | | | | | | | | | Present Invention Example |
| J | | | | | | | | | | | | | | | Present Invention Example |
| K | 0.14 | | | | | | | | | | 0.18 | | | | Present Invention Example |
| L | | 0.22 | | | | | | | | | | | | | Present Invention Example |
| M | | | 0.11 | | | | | | | | | | | 0.02 | Present Invention Example |
| N | | | | 0.25 | | | | | | | | | | | Present Invention Example |
| O | | | | | 0.0018 | | | | | | | 0.01 | | | Present Invention Example |
| P | | | | | | | | | | | | | | | Comparative Example |
| Q | | | | | | | | | | | | | | | Comparative Example |
| R | | | | | | | | | | | | | | | Comparative Example |
| S | | | | | | | | | | | | | | | Comparative Example |
| T | | | | | | | | | | | | | | | Comparative Example |
| U | | | | | | | | | | | | | | | Present Invention Example |
| V | | | | | | | | | | | | | | | Present Invention Example |

TABLE 3A

| Manufacturing No. | Steel No. | Holding time in temperature range of 700° C. to 850° C. s | Heating temperature ° C. | Holding time in temperature range of 1100° C. or higher s | Sheet thickness reduction in 850° C. to 1100° C. % | Stress loaded after rolling one stage before final stage before final stage rolling kPa | Hot rolling finishing temperature Tf ° C. | Rolling reduction of final stage % | Stress loaded after final stage rolling of hot rolling and until steel sheet being cooled to 800° C. kPa | Note |
|---|---|---|---|---|---|---|---|---|---|---|
| 1 | A | 1154 | 1249 | 9302 | 94 | 205 | 920 | 10 | 175 | Present Invention Example |
| 2 | B | 1262 | 1248 | 9377 | 96 | 237 | 951 | 9 | 173 | Present Invention Example |
| 3 | B | 755 | 1249 | 9408 | 95 | 218 | 968 | 8 | 179 | Comparative Example |
| 4 | B | 1483 | 1243 | 9189 | 88 | 219 | 963 | 10 | 194 | Comparative Example |
| 5 | B | 1333 | 1219 | 4391 | 93 | 234 | 951 | 9 | 191 | Comparative Example |
| 6 | B | 1267 | 1226 | 9017 | 96 | 150 | 952 | 9 | 195 | Comparative Example |
| 7 | B | 1266 | 1229 | 9176 | 95 | 210 | 1037 | 8 | 173 | Comparative Example |
| 8 | B | 1317 | 1213 | 8769 | 95 | 190 | 924 | 5 | 184 | Comparative Example |
| 9 | B | 1573 | 1247 | 9415 | 95 | 232 | 931 | 8 | 261 | Comparative Example |
| 10 | B | 1503 | 1247 | 9493 | 94 | 216 | 973 | 11 | 170 | Present Invention Example |

TABLE 3A-continued

| Manufacturing No. | Steel No. | Holding time in temperature range of 700° C. to 850° C. s | Heating temperature ° C. | Holding time in temperature range of 1100° C. or higher s | Sheet thickness reduction in 850° C. to 1100° C. % | Stress loaded after rolling one stage before final stage before final stage rolling kPa | Hot rolling finishing temperature Tf ° C. | Rolling reduction of final stage % | Stress loaded after final stage rolling of hot rolling and until steel sheet being cooled to 800° C. kPa | Note |
|---|---|---|---|---|---|---|---|---|---|---|
| 11 | B | 1255 | 1261 | 9366 | 96 | 200 | 940 | 11 | 189 | Comparative Example |
| 12 | B | 1380 | 1230 | 8951 | 95 | 224 | 930 | 11 | 177 | Comparative Example |
| 13 | B | 1488 | 1231 | 9426 | 93 | 210 | 929 | 9 | 178 | Comparative Example |
| 14 | B | 1254 | 1227 | 9069 | 94 | 208 | 926 | 8 | 177 | Comparative Example |
| 15 | C | 1136 | 1218 | 9418 | 95 | 221 | 924 | 11 | 184 | Present Invention Example |
| 16 | D | 1396 | 1222 | 9027 | 93 | 222 | 967 | 11 | 177 | Present Invention Example |
| 17 | E | 1256 | 1246 | 8888 | 95 | 212 | 970 | 11 | 190 | Present Invention Example |
| 18 | E | 1450 | 1234 | 9053 | 95 | 205 | 965 | 11 | 190 | Comparative Example |
| 19 | F | 1456 | 1222 | 9272 | 93 | 210 | 968 | 10 | 193 | Present Invention Example |
| 20 | G | 1394 | 1244 | 9087 | 93 | 204 | 1007 | 8 | 182 | Present Invention Example |
| 21 | H | 1213 | 1253 | 9130 | 95 | 172 | 957 | 8 | 186 | Present Invention Example |
| 22 | I | 1144 | 1234 | 9050 | 93 | 216 | 927 | 11 | 189 | Present Invention Example |
| 23 | J | 1256 | 1219 | 9104 | 95 | 216 | 960 | 8 | 194 | Present Invention Example |

Underlines indicate that manufacturing conditions are not preferable.

TABLE 3B

| Manufacturing No. | Steel No. | Holding time in temperature range of 700° C. to 850° C. s | Heating temperature ° C. | Holding time in temperature range of 1100°C or higher s | Sheet thickness reduction in 850° C. to 1100° C. % | Stress loaded after rolling one stage before final stage before final stage rolling kPa | Hot rolling finishing temperature Tf ° C. | Rolling reduction of final stage % | Stress loaded after final stage rolling of hot rolling and until steel sheet being cooled to 800° C. kPa | Note |
|---|---|---|---|---|---|---|---|---|---|---|
| 24 | K | 1364 | 1262 | 9078 | 94 | 218 | 971 | 9 | 185 | Present Invention Example |
| 25 | L | 1554 | 1258 | 9140 | 96 | 235 | 934 | 9 | 187 | Present Invention Example |
| 26 | M | 1521 | 1220 | 9012 | 94 | 223 | 970 | 9 | 179 | Present Invention Example |
| 27 | N | 1553 | 1232 | 9068 | 95 | 229 | 947 | 9 | 193 | Present Invention Example |
| 28 | O | 1280 | 1250 | 8988 | 96 | 204 | 968 | 11 | 185 | Present Invention Example |
| 29 | P | 1523 | 1254 | 9414 | 94 | 212 | 971 | 8 | 186 | Comparative. Example |
| 30 | Q | 1279 | 1260 | 9362 | 95 | 202 | 959 | 10 | 177 | Comparative Example |

TABLE 3B-continued

| Manufac-turing No. | Steel No. | Holding time in temperature range of 700° C. to 850° C. s | Heating temperature ° C. | Holding time in temperature range of 1100°C or higher s | Sheet thickness reduction in 850° C. to 1100° C. % | Stress loaded after rolling one stage before final stage before final stage rolling kPa | Hot rolling finishing temperature Tf ° C. | Rolling reduction of final stage % | Stress loaded after final stage rolling of hot rolling and until steel sheet being cooled to 800° C. kPa | Note |
|---|---|---|---|---|---|---|---|---|---|---|
| 31 | R | 1182 | 1255 | 9145 | 93 | 225 | 920 | 8 | 187 | Comparative Example |
| 32 | S | 1320 | 1244 | 9545 | 96 | 238 | 966 | 10 | 172 | Comparative Example |
| 33 | T | 1162 | 1253 | 9050 | 95 | 213 | 978 | 11 | 174 | Comparative Example |
| 34 | U | 1519 | 1249 | 9370 | 94 | 223 | 979 | 10 | 174 | Present Invention Example |
| 35 | U | 927 | 1252 | 9049 | 94 | 216 | 953 | 10 | 191 | Present Invention Example |
| 36 | U | 1316 | 1260 | 6770 | 93 | 214 | 931 | 10 | 183 | Present Invention Example |
| 37 | U | 1360 | 1261 | 8968 | 91 | 223 | 949 | 9 | 179 | Present Invention Example |
| 38 | U | 1249 | 1259 | 8922 | 95 | 207 | 964 | 10 | 182 | Present Invention Example |
| 39 | U | 839 | 1224 | 8941 | 95 | 214 | 930 | 10 | 184 | Comparative Example |
| 40 | U | 1146 | 1261 | 5516 | 93 | 234 | 942 | 10 | 172 | Comparative Example |
| 41 | U | 1412 | 1226 | 8976 | 94 | 165 | 940 | 12 | 171 | Comparative Example |
| 42 | U | 1291 | 1220 | 9283 | 94 | 201 | 926 | 7 | 171 | Comparative Example |
| 43 | U | 1402 | 1262 | 8997 | 95 | 204 | 970 | 10 | 218 | Comparative Example |
| 44 | U | 1196 | 1229 | 9113 | 96 | 229 | 963 | 10 | 185 | Comparative Example |
| 45 | V | 1509 | 1216 | 8863 | 94 | 237 | 965 | 10 | 178 | Present Invention Example |
| 46 | R | 1191 | 1242 | 9469 | 95 | 209 | 977 | 10 | 176 | Comparative Example |

Underlines indicate that manufacturing conditions are not preferable.

TABLE 4A

| Manufacturing No. | Steel No. | Cooling amount for 1 second after finishing of hot rolling ° C. | Average cooling rate of accelerated cooling ° C./s | Cooling stop temperature of accelerated cooling ° C. | Slow cooling time in temperature range of 600° C. to 730° C. s | Average cooling rate from stow cooling stop temperature to coiling temperature ° C./s | Coiling temperature ° C. | Note |
|---|---|---|---|---|---|---|---|---|
| 1 | A | 72 | 101 | 641 | 5.3 | 110 | 523 | Present Invention Example |
| 2 | B | 73 | 100 | 647 | 3.0 | 134 | 544 | Present Invention Example |
| 3 | B | 70 | 111 | 657 | 3.7 | 130 | 535 | Comparative Example |
| 4 | B | 60 | 97 | 648 | 4.0 | 147 | 485 | Comparative Example |
| 5 | B | 63 | 114 | 650 | 4.6 | 92 | 520 | Comparative Example |
| 6 | B | 74 | 111 | 641 | 5.1 | 103 | 522 | Comparative Example |
| 7 | B | 66 | 120 | 673 | 4.3 | 102 | 522 | Comparative Example |
| 8 | B | 57 | 62 | 680 | 3.8 | 82 | 500 | Comparative Example |

TABLE 4A-continued

| Manufacturing No. | Steel No. | Cooling amount for 1 second after finishing of hot rolling ° C. | Average cooling rate of accelerated cooling ° C./s | Cooling stop temperature of accelerated cooling ° C. | Slow cooling time in temperature range of 600° C. to 730° C. s | Average cooling rate from stow cooling stop temperature to coiling temperature ° C./s | Coiling temperature ° C. | Note |
|---|---|---|---|---|---|---|---|---|
| 9 | B | 78 | 125 | 674 | 4.2 | 100 | 517 | Comparative Example |
| 10 | B | 42 | 104 | 678 | 6.5 | 94 | 482 | Present Invention Example |
| 11 | B | 62 | 82 | 643 | 1.1 | 142 | 498 | Comparative Example |
| 12 | B | 65 | 36 | 680 | 3.9 | 121 | 503 | Comparative Example |
| 13 | B | 79 | 112 | 758 | 3.2 | 156 | 509 | Comparative Example |
| 14 | B | 79 | 116 | 643 | 4.3 | 25 | 507 | Comparative Example |
| 15 | C | 34 | 92 | 650 | 3.9 | 130 | 481 | Present Invention Example |
| 16 | D | 62 | 91 | 724 | 3.2 | 146 | 475 | Present Invention Example |
| 17 | E | 70 | 93 | 610 | 6.8 | 102 | 524 | Present Invention Example |
| 18 | E | 62 | 108 | 635 | 3.1 | 56 | 380 | Comparative Example |
| 19 | F | 59 | 100 | 624 | 3.2 | 135 | 518 | Present Invention Example |
| 20 | G | 68 | 88 | 715 | 4.7 | 99 | 531 | Present Invention Example |
| 21 | H | 73 | 116 | 625 | 5.8 | 124 | 513 | Present Invention Example |
| 22 | I | 75 | 80 | 664 | 2.2 | 106 | 476 | Present Invention Example |
| 23 | J | 62 | 104 | 676 | 3.0 | 95 | 485 | Present Invention Example |

Underlines indicate that manufacturing conditions are not preferable.

TABLE 4B

| Manufacturing No. | Steel No. | Cooling amount for 1 second after finishing of hot rolling ° C. | Average cooling rate of accelerated cooling ° C./s | Cooling stop temperature of accelerated cooling ° C. | Slow cooling time in temperature range of 600° C. to 730° C. s | Average cooling rate from slow cooling stop temperature to coiling temperature ° C./s | Coiling temperature ° C. | Note |
|---|---|---|---|---|---|---|---|---|
| 24 | K | 61 | 128 | 635 | 3.6 | 137 | 512 | Present Invention Example |
| 25 | L | 35 | 112 | 655 | 4.9 | 152 | 522 | Present Invention Example |
| 26 | M | 65 | 102 | 635 | 3.5 | 83 | 496 | Present Invention Example |
| 27 | N | 69 | 102 | 670 | 2.4 | 128 | 516 | Present Invention Example |
| 28 | O | 71 | 117 | 662 | 4.5 | 84 | 530 | Present Invention Example |
| 29 | P | 76 | 125 | 605 | 4.3 | 91 | 504 | Comparative Example |
| 30 | Q | 80 | 115 | 724 | 5.3 | 82 | 540 | Comparative Example |
| 31 | R | 67 | 113 | 604 | 6.0 | 133 | 518 | Comparative Example |
| 32 | S | 59 | 109 | 613 | 4.7 | 152 | 473 | Comparative Example |
| 33 | T | 73 | 107 | 632 | 3.3 | 115 | 492 | Comparative Example |
| 34 | U | 80 | 92 | 658 | 3.8 | 147 | 470 | Present Invention Example |
| 35 | U | 69 | 107 | 631 | 4.3 | 105 | 490 | Present Invention Example |

TABLE 4B-continued

| Manufacturing No. | Steel No. | Cooling amount for 1 second after finishing of hot rolling ° C. | Average cooling rate of accelerated cooling ° C./s | Cooling stop temperature of accelerated cooling ° C. | Slow cooling time in temperature range of 600° C. to 730° C. s | Average cooling rate from slow cooling stop temperature to coiling temperature ° C./s | Coiling temperature ° C. | Note |
|---|---|---|---|---|---|---|---|---|
| 36 | U | 65 | 80 | 640 | 4.4 | 139 | 505 | Present Invention Example |
| 37 | U | 63 | 108 | 665 | 4.5 | 133 | 496 | Present Invention Example |
| 38 | U | 51 | 100 | 679 | 3.6 | 122 | 524 | Present Invention Example |
| 39 | U | 73 | 94 | 639 | 3.7 | 144 | 519 | Comparative Example |
| 40 | U | 77 | 87 | 627 | 3.8 | 137 | 499 | Comparative Example |
| 41 | U | 64 | 87 | 647 | 3.2 | 139 | 482 | Comparative Example |
| 42 | U | 74 | 90 | 632 | 3.1 | 97 | 525 | Comparative Example |
| 43 | U | 63 | 97 | 629 | 3.2 | 149 | 494 | Comparative Example |
| 44 | U | 61 | 91 | 649 | 1.7 | 111 | 525 | Comparative Example |
| 45 | V | 71 | 90 | 634 | 4.1 | 93 | 497 | Present Invention Example |
| 46 | R | 67 | 87 | 623 | 2.1 | 141 | 386 | Comparative Example |

Underlines indicate that manufacturing conditions are not preferable.

TABLE 5A

| Manufacturing No. | Steel no. | Sheet thickness mm | Ferrite Area % | Residual austenite Area % | Pearlite Area % | Remainder in microstructure Area % | E value — | I value — | Mn standard deviation Mass % | Average crystal grain size of surface layer μm | Note |
|---|---|---|---|---|---|---|---|---|---|---|---|
| 1 | A | 2.6 | 58.2 | 0.0 | 0.0 | 41.8 | 11.1 | 1.015 | 0.48 | 2.8 | Present Invention Example |
| 2 | B | 2.6 | 22.2 | 0.0 | 0.0 | 77.8 | 11.1 | 1.013 | 0.42 | 2.5 | Present Invention Example |
| 3 | B | 2.6 | 28.0 | 0.0 | 0.0 | 72.0 | 11.0 | 1.008 | 0.62 | 2.2 | Comparative Example |
| 4 | B | 2.6 | 21.2 | 0.0 | 0.0 | 78.8 | 10.9 | 1.008 | 0.63 | 2.2 | Comparative Example |
| 5 | B | 2.6 | 33.7 | 0.0 | 0.0 | 66.3 | 10.9 | 1.015 | 0.70 | 2.4 | Comparative Example |
| 6 | B | 2.6 | 21.3 | 0.0 | 0.0 | 78.7 | 10.5 | 1.015 | 0.46 | 2.1 | Comparative Example |
| 7 | B | 2.6 | 23.9 | 0.0 | 0.0 | 76.1 | 10.4 | 1.004 | 0.49 | 2.7 | Comparative Example. |
| 8 | B | 2.6 | 26.8 | 0.0 | 0.0 | 73.2 | 10.6 | 1.011 | 0.50 | 2.4 | Comparative Example |
| 9 | B | 2.6 | 31.5 | 0.0 | 0.0 | 68.5 | 10.6 | 1.003 | 0.44 | 2.1 | Comparative Example |
| 10 | B | 2.6 | 21.6 | 0.0 | 0.0 | 78.4 | 10.9 | 1.007 | 0.43 | 3.1 | Present Invention Example |
| 11 | B | 2.6 | 10.1 | 0.0 | 0.0 | 89.9 | 11.1 | 1.002 | 0.48 | 2.5 | Comparative Example |
| 12 | B | 2.6 | 54.6 | 0.0 | 6.3 | 39.1 | 11.0 | 1.015 | 0.50 | 2.5 | Comparative Example |
| 13 | B | 2.6 | 61.1 | 0.0 | 5.2 | 33.7 | 11.1 | 1.016 | 0.41 | 2.4 | Comparative Example |
| 14 | B | 2.6 | 46.9 | 0.0 | 7.3 | 45.8 | 11.0 | 1.010 | 0.47 | 2.4 | Comparative Example |
| 15 | C | 6.0 | 16.9 | 0.0 | 0.0 | 83.1 | 10.9 | 1.001 | 0.49 | 3.3 | Present Invention Example |

TABLE 5A-continued

| Manufacturing No. | Steel no. | Sheet thickness mm | Ferrite Area % | Residual austenite Area % | Pearlite Area % | Remainder in microstructure Area % | E value — | I value — | Mn standard deviation Mass % | Average crystal grain size of surface layer μm | Note |
|---|---|---|---|---|---|---|---|---|---|---|---|
| 16 | D | 2.6 | 18.6 | 0.0 | 0.0 | 81.4 | 10.9 | 1.000 | 0.48 | 2.5 | Present Invention Example |
| 17 | E | 2.6 | 40.7 | 1.5 | 0.0 | 57.8 | 11.0 | 1.015 | 0.42 | 2.0 | Present Invention Example |
| 18 | E | 2.6 | 20.5 | 5.1 | 0.0 | 74.4 | 11.0 | 1.025 | 0.43 | 2.1 | Comparative Example |
| 19 | F | 1.6 | 43.4 | 0.0 | 2.0 | 54.6 | 10.7 | 1.013 | 0.49 | 2.4 | Present Invention Example |
| 20 | G | 2.6 | 16.6 | 0.0 | 0.0 | 83.4 | 11.0 | 1.003 | 0.57 | 2.5 | Present Invention Example |
| 21 | H | 2.6 | 22.2 | 0.0 | 0.0 | 77.8 | 10.7 | 1.001 | 0.43 | 2.2 | Present Invention Example |
| 22 | I | 2.6 | 16.5 | 0.0 | 0.0 | 83.5 | 10.9 | 1.009 | 0.43 | 2.2 | Present Invention Example |
| 23 | J | 2.6 | 32.4 | 0.0 | 0.0 | 67.6 | 11.2 | 1.011 | 0.43 | 2.0 | Present Invention Example |

Underlines indicate that corresponding values are outside the range of the present invention or not preferable properties.

TABLE 5B

| Manufacturing No. | Steel no. | Sheet thickness mm | Ferrite Area % | Residual austenite Area % | Pearlite Area % | Remainder in microstructure Area % | E value — | I value — | Mn standard deviation Mass % | Average crystal grain size of surface layer μm | Note |
|---|---|---|---|---|---|---|---|---|---|---|---|
| 24 | K | 2.6 | 26.0 | 0.0 | 0.0 | 74.0 | 11.2 | 1.013 | 0.49 | 2.5 | Present Invention Example |
| 25 | L | 2.6 | 33.6 | 0.0 | 0.0 | 66.4 | 10.9 | 1.010 | 0.51 | 3.8 | Present Invention Example |
| 26 | M | 2.6 | 25.3 | 0.0 | 0.0 | 74.7 | 11.2 | 1.005 | 0.43 | 2.5 | Present Invention Example |
| 27 | N | 2.6 | 17.6 | 0.0 | 0.0 | 82.4 | 11.1 | 1.011 | 0.51 | 2.0 | Present Invention Example |
| 28 | O | 2.6 | 29.2 | 0.0 | 0.0 | 70.8 | 11.0 | 1.011 | 0.46 | 2.0 | Present Invention Example |
| 29 | P | 2.6 | 70.5 | 0.0 | 0.0 | 29.5 | 10.9 | 1.023 | 0.39 | 2.1 | Comparative Example |
| 30 | Q | 2.6 | 1.6 | 1.3 | 1.0 | 96.1 | 10.9 | 1.015 | 0.43 | 2.1 | Comparative Example |
| 31 | R | 2.6 | 60.9 | 2.4 | 0.0 | 36.7 | 11.2 | 1.005 | 0.40 | 3.2 | Comparative Example |
| 32 | S | 2.6 | 75.3 | 0.0 | 0.0 | 24.7 | 11.1 | 1.006 | 0.51 | 2.2 | Comparative Example |
| 33 | T | 2.6 | 32.2 | 0.0 | 0.0 | 67.8 | 10.9 | 1.015 | 0.42 | 2.3 | Comparative Example |
| 34 | U | 3.2 | 38.9 | 0.0 | 0.0 | 61.1 | 11.1 | 1.006 | 0.39 | 2.0 | Present Invention Example |
| 35 | U | 3.2 | 52.6 | 0.0 | 0.0 | 47.4 | 11.0 | 1.006 | 0.51 | 2.3 | Present Invention Example |
| 36 | U | 3.2 | 47.9 | 0.0 | 0.0 | 52.1 | 11.1 | 1.016 | 0.52 | 2.4 | Present Invention Example |

TABLE 5B-continued

| Manufacturing No. | Steel no. | Sheet thickness mm | Ferrite Area % | Residual austenite Area % | Pearlite Area % | Remainder in microstructure Area % | E value — | I value — | Mn standard deviation Mass % | Average crystal grain size of surface layer μm | Note |
|---|---|---|---|---|---|---|---|---|---|---|---|
| 37 | U | 3.2 | 38.6 | 0.0 | 0.0 | 61.4 | 11.1 | 1.007 | 0.54 | 2.3 | Present Invention Example |
| 38 | U | 3.2 | 31.8 | 0.0 | 0.0 | 68.2 | 11.2 | 1.015 | 0.49 | 2.3 | Present Invention Example |
| 39 | U | 3.2 | 47.6 | 0.0 | 0.0 | 52.4 | 11.1 | 1.006 | 0.62 | 2.4 | Comparative Example |
| 40 | U | 3.2 | 55.2 | 0.0 | 0.0 | 44.8 | 11.0 | 1.010 | 0.65 | 2.1 | Comparative Example |
| 41 | U | 3.2 | 40.4 | 0.0 | 0.0 | 59.6 | 10.5 | 1.018 | 0.44 | 2.1 | Comparative Example |
| 42 | U | 3.2 | 40.7 | 0.0 | 0.0 | 59.3 | 10.5 | 1.007 | 0.46 | 2.2 | Comparative Example |
| 43 | U | 3.2 | 58.1 | 0.0 | 0.0 | 41.9 | 10.3 | 1.003 | 0.44 | 2.4 | Comparative Example |
| 44 | U | 3.2 | 13.8 | 0.0 | 0.0 | 86.2 | 11.0 | 1.005 | 0.44 | 2.1 | Comparative Example |
| 45 | V | 2.9 | 31.9 | 0.0 | 0.0 | 68.1 | 11.0 | 1.015 | 0.41 | 2.3 | Present Invention Example |
| 46 | R | 2.6 | 62.8 | 13.4 | 0.0 | 23.8 | 10.9 | 1.012 | 0.50 | 2.5 | Comparative Example |

Underlines indicate that corresponding values are outside the range of the present invention or not preferable properties.

TABLE 6A

| Manufacturing No. | Steel No. | Tensile strength TS MPa | Total elongation El % | TS × El MPa · % | Minimum value of sheared surface proportion/maximum value of sheared surface proportion — | Limit bend R/t — | Note |
|---|---|---|---|---|---|---|---|
| 1 | A | 986 | 17.5 | 17222 | 0.76 | 2.1 | Present Invention Example |
| 2 | B | 1006 | 16.8 | 16867 | 0.77 | 2.5 | Present Invention Example |
| 3 | B | 1017 | 16.4 | 16669 | 0.58 | 2.2 | Comparative Example |
| 4 | B | 1031 | 16.3 | 16822 | 0.54 | 2.5 | Comparative Example |
| 5 | B | 1014 | 15.6 | 15796 | 0.69 | 2.3 | Comparative Example |
| 6 | B | 1037 | 16.7 | 17271 | 0.61 | 2.1 | Comparative Example |
| 7 | B | 1015 | 15.8 | 16072 | 0.59 | 2.4 | Comparative Example |
| 8 | B | 1023 | 15.2 | 15550 | 0.60 | 2.3 | Comparative Example |
| 9 | B | 1032 | 15.3 | 15764 | 0.67 | 2.1 | Comparative Example |
| 10 | B | 999 | 16.0 | 15968 | 0.87 | 2.6 | Present Invention Example |
| 11 | B | 1026 | 13.5 | 13851 | 0.90 | 2.1 | Comparative Example |
| 12 | B | 958 | 14.9 | 14274 | 0.89 | 2.2 | Comparative Example |
| 13 | B | 930 | 16.0 | 14880 | 0.79 | 2.2 | Comparative Example |
| 14 | B | 972 | 15.2 | 14774 | 0.80 | 2.2 | Comparative Example |
| 15 | C | 1429 | 12.2 | 17434 | 0.91 | 2.9 | Present Invention Example |
| 16 | D | 1038 | 14.8 | 15362 | 0.86 | 2.3 | Present Invention Example |
| 17 | E | 1057 | 14.2 | 15009 | 0.84 | 2.2 | Present Invention Example |
| 18 | E | 1113 | 14.5 | 16139 | 0.50 | 2.1 | Comparative Example |

TABLE 6A-continued

| Manufacturing No. | Steel No. | Tensile strength TS MPa | Total elongation El % | TS × El MPa · % | Minimum value of sheared surface proportion/maximum value of sheared surface proportion — | Limit bend R/t — | Note |
|---|---|---|---|---|---|---|---|
| 19 | F | 990 | 17.1 | 16910 | 0.71 | 2.2 | Present Invention Example |
| 20 | G | 1082 | 14.1 | 15256 | 0.73 | 2.3 | Present Invention Example |
| 21 | H | 983 | 17.3 | 17046 | 0.70 | 2.0 | Present Invention Example |
| 22 | I | 1032 | 15.0 | 15480 | 0.88 | 2.3 | Present invention Example |
| 23 | J | 999 | 16.4 | 16402 | 0.88 | 2.5 | Present Invention Example |

Underlines indicate that corresponding values are outside the range of the present invention or not preferable properties.

TABLE 6B

| Manufacturing No. | Steel No. | Tensile strength TS MPa | Total elongation El % | TS × El MPa · % | Minimum value of sheared surface proportion/maximum value of sheared surface proportion — | Limit bend R/t — | Note |
|---|---|---|---|---|---|---|---|
| 24 | K | 1016 | 16.3 | 16597 | 0.78 | 2.3 | Present Invention Example |
| 25 | L | 1020 | 16.1 | 16376 | 0.79 | 2.8 | Present Invention Example |
| 26 | M | 1037 | 15.4 | 16011 | 0.86 | 2.5 | Present Invention Example |
| 27 | N | 1022 | 14.9 | 15228 | 0.91 | 2.1 | Present Invention Example |
| 28 | O | 1028 | 16.8 | 17236 | 0.86 | 2.2 | Present Invention Example |
| 29 | P | 922 | 15.6 | 14383 | 0.65 | 2.1 | Comparative Example |
| 30 | Q | 1658 | 11.3 | 18735 | 0.85 | 2.2 | Comparative Example |
| 31 | R | 1021 | 14.2 | 14498 | 0.86 | 2.6 | Comparative Example |
| 32 | S | 955 | 17.1 | 16367 | 0.88 | 2.2 | Comparative Example |
| 33 | T | 968 | 17.0 | 16432 | 0.61 | 2.1 | Comparative Example |
| 34 | U | 1054 | 16.8 | 17707 | 0.89 | 2.3 | Present Invention Example |
| 35 | U | 1064 | 16.0 | 17024 | 0.75 | 2.4 | Present Invention Example |
| 36 | U | 1068 | 16.7 | 17836 | 0.77 | 2.5 | Present Invention Example |
| 37 | U | 1047 | 15.3 | 16019 | 0.79 | 2.4 | Present Invention Example |
| 38 | U | 1051 | 16.9 | 17762 | 0.91 | 2.5 | Present Invention Example |
| 39 | U | 1043 | 15.9 | 16584 | 0.69 | 2.3 | Comparative Example |
| 40 | U | 1050 | 15.7 | 16485 | 0.67 | 2.4 | Comparative Example |
| 41 | U | 1065 | 16.6 | 17679 | 0.55 | 2.1 | Comparative Example |
| 42 | U | 1034 | 16.0 | 16544 | 0.64 | 2.5 | Comparative Example |
| 43 | U | 1039 | 16.4 | 17040 | 0.66 | 2.2 | Comparative Example |
| 44 | U | 1030 | 14.0 | 14420 | 0.88 | 2.2 | Comparative Example |
| 45 | V | 1055 | 16.0 | 16880 | 0.79 | 2.2 | Present Invention Example |
| 46 | R | 1022 | 19.6 | 20031 | 0.52 | 2.5 | Comparative Example |

Underlines indicate that corresponding values are outside the range of the present invention or not preferable properties.

From Table 5A to Table 6B, it is found that the hot-rolled steel sheets according to the present invention examples have excellent strength, ductility and shearing property. In addition, it is found that, among the present invention examples, the hot-rolled steel sheets where the average crystal grain size of the surface layer was less than 3.0 m had the above various properties and further had excellent inside bend cracking resistance.

On the other hand, it is found that the hot-rolled steel sheets according to the comparative examples did not have any one or more of excellent strength, ductility, and shearing property.

INDUSTRIAL APPLICABILITY

According to the above aspect of the present invention, it is possible to provide a hot-rolled steel sheet having excellent strength, ductility, and shearing property. In addition, according to the preferable aspect according to the present invention, it is possible to obtain a hot-rolled steel sheet which has the above various properties and, furthermore, suppresses the occurrence of inside bend cracking, that is, has excellent inside bend cracking resistance.

The hot-rolled steel sheet according to the present invention is suitable as an industrial material used for vehicle members, mechanical structural members, and building members.

What is claimed is:

1. A hot-rolled steel sheet comprising, in terms of mass %, as a chemical composition:

C: 0.050% to 0.250%;
Si: 0.05% to 3.00%;
Mn: 1.00% to 4.00%;
one or more of Ti, Nb, and V: 0.060% to 0.500% in total;
sol. Al: 0.001% to 2.000%;
P: 0.100% or less;
S: 0.0300% or less;
N: 0.1000% or less;
O: 0.0100% or less;
Cu: 0% to 2.00%;
Cr: 0% to 2.00%;
Mo: 0% to 1.00%;
Ni: 0% to 2.00%;
B: 0% to 0.0100%;
Ca: 0% to 0.0200%;
Mg: 0% to 0.0200%;
REM: 0% to 0.1000%;
Bi: 0% to 0.020%;
one or more of Zr, Co, Zn, and W: 0% to 1.00% in total;
Sn: 0% to 0.05%; and
a remainder comprising Fe and impurities,
wherein, in a microstructure,
in terms of area %, residual austenite is less than 3.0%, ferrite is 15.0% or more and less than 60.0%, and pearlite is less than 5.0%,
an E value that indicates periodicity of the microstructure is 10.7 or more, and an I value that indicates uniformity of the microstructure is less than 1.020,
a standard deviation of a Mn concentration is 0.60 mass % or less, and
a tensile strength is 980 MPa or more.

2. The hot-rolled steel sheet according to claim 1,
wherein an average crystal grain size of a surface layer is less than 3.0 m.

3. The hot-rolled steel sheet according to claim 1, further comprising, in terms of mass %, one or more of, as the chemical composition:

Cu: 0.01% to 2.00%;
Cr: 0.01% to 2.00%;
Mo: 0.01% to 1.00%;
Ni: 0.02% to 2.00%;
B: 0.0001% to 0.0100%;
Ca: 0.0005% to 0.0200%;
Mg: 0.0005% to 0.0200%;
REM: 0.0005% to 0.1000%; and
Bi: 0.0005% to 0.020%.

4. The hot-rolled steel sheet according to claim 2, further comprising, in terms of mass %, one or more of, as the chemical composition:

Cu: 0.01% to 2.00%;
Cr: 0.01% to 2.00%;
Mo: 0.01% to 1.00%;
Ni: 0.02% to 2.00%;
B: 0.0001% to 0.0100%;
Ca: 0.0005% to 0.0200%;
Mg: 0.0005% to 0.0200%;
REM: 0.0005% to 0.1000%; and
Bi: 0.0005% to 0.020%.

* * * * *